US005845444A

United States Patent [19]

Besche

[11] Patent Number: 5,845,444

[45] **Date of Patent: *Dec. 8, 1998**

[54] MASONRY REINFORCEMENT

[76] Inventor: Charles F. Besche, 30 Severndale Rd., Severna Park, Md. 21146

[ * ] Notice: The term of this patent shall not extend beyond the expiration date of Pat. No. 5,596,857.

[21] Appl. No.: 785,861

[22] Filed: Jan. 21, 1997

Related U.S. Application Data

[63] Continuation-in-part of Ser. No. 347,899, Dec. 1, 1994, Pat. No. 5,596,857.

[51] Int. Cl.[6] ..... E04B 2/48

[52] U.S. Cl. ..... 52/421; 52/100; 52/293.2; 52/442; 52/503

[58] Field of Search ..... 52/98, 100, 293.2, 52/421, 439, 442, 503, 505, 562, 566, 567, 606, 607

[56] References Cited

U.S. PATENT DOCUMENTS

| | | | |
|---|---|---|---|
| Re. 13,980 | 9/1915 | Smith . | |
| 692,544 | 2/1902 | Record . | |
| 1,113,585 | 10/1914 | Smith . | |
| 1,297,151 | 3/1919 | Griffin . | |
| 1,311,082 | 7/1919 | Mock . | |
| 1,625,628 | 4/1927 | Scarth . | |
| 2,013,736 | 9/1935 | Stirrup . | |
| 2,045,033 | 6/1936 | Kissinger . | |
| 2,055,184 | 9/1936 | Stirrup . | |
| 2,176,986 | 10/1939 | Briscoe . | |
| 2,325,653 | 8/1943 | Bingham . | |
| 2,776,559 | 1/1957 | Summers . | |
| 2,861,388 | 11/1958 | Fravaretto | 52/606 X |
| 3,382,632 | 5/1968 | Grofcsik | 52/606 X |
| 3,780,773 | 12/1973 | Haugen . | |
| 3,834,100 | 9/1974 | Healey | 52/607 X |
| 4,110,949 | 9/1978 | Cambiuzzi et al. | 52/606 X |
| 4,375,143 | 3/1983 | Godlewski . | |
| 5,193,320 | 3/1993 | Coccagna . | |
| 5,596,857 | 1/1997 | Besche | 52/421 |

*Primary Examiner*—Carl D. Friedman
*Assistant Examiner*—Kevin D. Wilkens
*Attorney, Agent, or Firm*—Leonard Bloom

[57] ABSTRACT

A strengthened masonry reinforcement device is used in construction to strengthen the courses of laid hollow block. The masonry reinforcement device is fashioned with ends and a strengthened trough. When used in the construction of a wall the masonry device with the strengthened trough will be light-weight and retain cement to bind hollow block in a lower course to hollow block of an adjacent upper course.

9 Claims, 19 Drawing Sheets

MASONRY REINFORCEMENT

CROSS REFERENCE TO RELATED APPLICATIONS

This application is a continuation-in-part of application Ser. No. 08/347,899, filed Dec. 1, 1994, now U.S. Pat. No. 5,596,857.

FIELD OF THE INVENTION

The invention herein described relates to construction and the reinforcement of masonry block walls and structures.

BACKGROUND OF THE INVENTION

Building with block, and particularly concrete and cinder block, are types of construction well known to contractors, builders and masons.

Cinder block and concrete block are hollow core block finding widespread use in building. This block is a well-known and conventionally used material for constructing the foundation and footings of a building. Hollow block construction is also a convenient and economical means for erecting building walls, particularly where the walls have windows and doors.

Concrete hollow block, also referred in the art as a concrete masonry unit, ("CMU") is supplied in a variety of sizes. The standard size and that most used is a block 8×8×16 (7⅝×7⅝×15⅝) inches. This block is generally manufactured to have one, two or three cells or cores. The lateral dividing walls forming the core or cells of the block are sometimes called webs. While the standard width of the conventional block is 8 inches, blocks of 4, 6, 10 and 12 inch widths are available. The blocks or CMU's generally come in two external configurations: stretcher blocks which do not have finished ends, and corner blocks which have a finished corner (that is, two finished facing sides at right angles to one another).

There is a continuing need to improve the efficiency and strength of walls built of block. In using block construction, there is a tendency for the walls to be somewhat weak and for the joints to crack. Industry continuously seeks ways of improving the strength of structures where block is used.

One prior art product used for strengthening hollow block construction is a wire-mesh or grid called "Durowire"; others are Block mesh, Truss wire and Block wire. This product is designed to strengthen mortar joints between courses of block. In use, a course of block is laid and then mortar is enmeshed in the wire or grid. Then a second course of block is laid over the wire mesh and mortar of the first course of block. While this wire product supplies lateral strength, horizontally block to block, it does not supply substantial vertical strength between the vertical courses of adjacent block.

Unlike the wire mesh method the method of this invention accomplishes adjacent vertical bonding between blocks, strength is increased and cracks in the mortar joints reduced.

Still another prior art method of block wall construction involves mortar poured directly into the hollows or cavities of the block to strengthen the wall. While this type of wall is strong, there are disadvantages. Firstly, this type of wall is costly to build due to the added mortar required to fill the entire cavity of the block. Secondly, there is a need to wait for the mortar between the joints of the block to set-up before mortar can be poured into the hollows. If pouring is done before set-up, the mortar poured into the hollows will force the still wet mortar out of the joints. It is clear that with the pour method, valuable time is lost because the steps of the pouring process are time-consuming.

A still further type of construction uses poured concrete walls rather than block. While the poured concrete method has the advantage of strength, it requires on-site forms; and it is not an efficient method of construction where doors and windows have to be placed in the wall.

The patent literature describes prior art showing various means and methods for reinforcing and strengthening construction in which hollow block is used.

Smith in U.S. Pat. No. 1,113,585 discloses a binder for hollow tile building blocks. The binder has slots through which cement flows to bind one row of block with the other. In addition to the slots, the binder is wide enough to catch and contain cement, thus preventing the cement from falling into the hollows of the blocks.

U.S. Pat. No. 1,297,151 to Griffin discloses a building block with notches for receiving reinforcing rods carried in the notches. A metal plate is fixed below the notches to receive cement which is retained therein to seal the rods in the notches.

A device for tile closure is taught by Scarth in U.S. Pat. No. 1,625,628. The device is designed to close the ends of tile used in building construction to prevent cement from entering the hollows of the block. This tile closure device is useful for sealing the hollows of tile block when cement is poured in areas adjacent to the block. The closure device thereby saves cement which would have been wasted during the pouring process.

Bingham in U.S. Pat. No. 2,325,653 teaches a wall construction system employing a spacer element placed between the rows or courses of block to prevent water seepage through the cement bonds between the rows of block. The spacer element also prevents cement from falling into the hollows of the block, thus saving cement.

In U.S. Pat. No. 2,776,559 Summers teaches the reinforcement of block wall construction by placing spacers between the courses of block along with reinforcing wire supported between the courses of brick.

None of these prior art patents discloses a contoured insert fitting between the courses of hollow block in such a way that mortar when poured into the hollow of a top block will internally, and within the cell, bind the top block to the bottom block.

Additional prior art discloses devices used to plug the openings of hollow tile. These devices are exemplified by Kissinger U.S. Pat. No. 2,045,033; Mock U.S. Pat. No. 1,311,082 and Stirrup U.S. Pat. No. 2,013,736. The masonry reinforcement device of this invention has many significant advantages and features of novelty not contemplated by the references of the prior art. The prior art does not recognize the concept of using a light-weight material which has been modified by stiffening means to prevent its buckling when an amount of cement is applied to the trough. Nor does the prior art use a single masonry reinforcement device between courses of hollow block to bind one course to the other. Note further that the prior art does not apply cement in the top hollow of a block to land in a trough to key courses of block. Of most importance, the prior art does not show the inventor's structural modifications used to stiffen the light-weight material forming the reinforcement device.

SUMMARY OF THE INVENTION

The primary object of the disclosed invention is the reinforcing of hollow block (e.g., hollow concrete block) used in various types of construction.

A further object of this invention is to tie a lower course of hollow block to an adjacent upper course of hollow block, producing added lateral and vertical stability to the rows of hollow block.

A further object of this invention is to provide a means for reinforcing courses of block efficiently and economically.

The objects of this invention are realized through the use of masonry reinforcement plates or strips. These plates or strips are shaped to form troughs when they are placed over the hollows of the masonry block. In use, a bottom or first course of block is laid. The reinforcement plate is placed on the top of the block and within the hollow. Mortar is then applied to the first course of block. A second course of block is set on top of the first course of block, as well as over the masonry reinforcement plate. Mortar is then dropped into the hollow of the block of the second or top course. The dropped mortar lands onto the trough of the masonry reinforcement plate and builds up to internally key or bind the first course of block to the second. The depressed trough or pocket of the plate catches the dropped mortar, thereby facilitating the keying and bonding of the bottom block to the adjacent top block using, a minimum amount of mortar.

It is evident that this inventive process using the masonry reinforcement plates, unlike processes in which the entire cavity is filled, saves mortar and at the same time provides vertical block-to-block binding or keying between the courses of block. In addition unlike the process where the entire hollow of the block is filled, there is no need to wait before dropping mortar into the hollow since the rather small amount of mortar added to the hollow will not be enough to force mortar from between the courses of laid block, The masonry reinforcement device can be fashioned with a trough to fit over a single hollow cell or over a double hollow cell. The reinforcement device can also be fashioned with troughs to fit over multiple hollow cells and straddle the lateral dividing wall of a single block or the two lateral end walls of adjoining block in a course. The trough must be deep enough to hold adequate mortar for keying a bottom block, usually ¼" to ¾".

As an added feature, the reinforcement device of this invention is fashioned to accommodate the outdent in the hollow cell of a corner block; or the outdent which can be found in various block, other than corner block. The reinforcement strip is made with perforations outlining a knock-out for the outdent. Ordinarily, an entire strip is used over the block. The strip is manufactured with perforations or break-points, which make breaking off of the knock-out easy. With the knock-out removed the reinforcement strip can accommodate the outdent of a corner block or any other block having an outdent. As a unique feature of this invention, a single strip with perforations can be used on block, either with or without the outdent; when used on a block with an outdent, simply remove the knock-out. Along with the outdent knock-out the strip can be manufactured with a lateral perforation to split or separate the strip so that it will be able to be positioned over a wider center lateral wall in corner block.

As described above, hollow block is generally produced with one, two or three cells or hollows. The masonry reinforcement of this invention will generally be described as being applicable to the hollow block of two cells or hollows. It is clear, however, that the masonry reinforcement device as generally defined by this invention can find applicability to block of one or three cells or to an extended series of cells presented by the laying of a course of block.

As an embodiment of this invention there is described a masonry reinforcement device for reinforcing courses of hollow block in masonry construction. Said hollow block is of a rectangular configuration, and has a top first end, a top second end and two exposed hollow cells formed by a lateral wall in the center of said hollow block. Said masonry reinforcement is made of stiffened material and comprises a first end, a second end and an elongated surface between said first end and said second end. The first end and second end of said masonry reinforcing device are shaped to fit on the top first end and top second end of said hollow masonry block, respectively. The elongated surface between said first end and said second end of the masonry reinforcing device defining two troughs to be positioned over said two exposed hollow cells and lateral wall. When the masonry reinforcement device is positioned over exposed hollow cells of hollow masonry block in a bottom course of hollow block, a top course of hollow masonry block is set over the block in the bottom course of block and an adequate amount of mortar dropped into the exposed hollow cells of the top masonry block, the dropped mortar will land in said troughs to bind and adhere the interior hollow cell surfaces of both the bottom hollow block and the top hollow block and thereby form a secure bond between the blocks.

A special embodiment of this invention describes a masonry reinforcement device for reinforcing courses of hollow block in masonry construction. Said hollow block is of a rectangular configuration, and has a top first end, a top second end and two exposed hollow cells formed by a lateral wall in the center of said hollow block. Said masonry reinforcement device being made of stiffened material and comprising a first end, a second end and an elongated surface between said first end and said second end. The first end and second end of said masonry reinforcing device being shaped to fit on the top first end lateral wall in the center of said hollow masonry block, respectively. The elongated surface between said first end and said second end of the masonry reinforcing device defining a trough to be positioned over a single cell in said block. When said masonry reinforcement device is positioned over an exposed cell of hollow masonry block in a bottom course of block, a top hollow masonry block is set over the bottom block and an adequate amount of mortar dropped into the exposed hollow cell of the top masonry block, the mortar will land in said trough to bind and adhere the interior hollow cell surfaces of both the bottom and top hollow masonry block and thereby form a secure bond between the blocks.

Another special embodiment of this invention describes a masonry reinforcing device designed to be applied over two adjacent abutting hollow blocks in a course of hollow block in masonry construction. Each of said abutting hollow blocks has a rectangular configuration, a top first end, a top second end and two exposed hollow cells formed by a lateral wall in the center of said hollow block. The two adjacent abutting hollow blocks presenting a top first end, a remote top second end, lateral walls and a thickened center section formed by the juxtaposition of abutting end walls of the adjacent abutting hollow block. Said masonry reinforcement device being made of stiffened material and comprising a first end, a remote second end and an elongated surface between said first end and said remote second end. The first end and remote second end of said masonry reinforcing device being shaped to fit on the top of said first end of said two adjacent abutting hollow blocks and said remote top second end of said two adjacent abutting hollow blocks. Said elongated surface between said first end and remote second end of said masonry reinforcement device being shaped to fit over the lateral walls and thickened center section formed by the juxtaposition of abutting end walls of said adjacent hollow block, and with said elongated surface forming several troughs to fit into said exposed hollow cells formed by said lateral walls in the center of said hollow blocks. When the masonry reinforcement device is positioned over exposed hollow cells of hollow masonry blocks in a bottom course of block, and a top course of hollow masonry block is set over the bottom course of block and an adequate amount of mortar dropped into an exposed hollow cell of the top masonry block, the mortar will land in said troughs to bind and adhere to the interior hollow cell surfaces of both the bottom and top hollow masonry blocks and thereby form a secure bond between the blocks.

As a unique embodiment the masonry reinforcement device has at its first end a perforated knock-out for accommodating an outdent in the cell of hollow masonry block, e.g. a corner block. The knock-out can be removed and the masonry reinforcement device can accommodate said outdent.

The herein disclosed invention envisions a building wall, wherein at least two hollow core masonry blocks are stacked vertically and are staggered longitudinally. The blocks including an upper block and a lower block and having respective communicating cores formed therein. The blocks having respective flat surfaces between which mortar is placed. Said building wall being in combination with a masonry reinforcing device disposed between the upper and lower blocks and including at least one trough portion which is received within the core of the lower block, such that additional mortar may be dropped through the core of the upper block to fall into the trough portion of the masonry reinforcing device in the lower block. The additional mortar being sufficient to be disposed conjointly between the respective cores of the upper and lower blocks, thereby vertically keying the upper and lower blocks together for substantially increased vertical or lateral strength of the building wall, and such that the additional mortar does not displace the mortar between the respective flat surfaces of the upper and lower blocks. Said combination can further comprise the masonry reinforcing device having a strip disposed between the respective flat surfaces of the upper and lower blocks. The strip can have a length substantially aligned with the length of the building wall and further having a width slightly less than the width of the respective cores in the upper and lower blocks, and with the strip being bent at angles to the length thereof to form the at least one trough portion in the strip. Further, the strip may float in the plane between the upper and lower blocks to accommodate manufacturing variations in the upper and lower blocks and tolerance accumulations therebetween, As a special feature the masonry reinforcement device has at its elongated surface between the first end and second end, and between troughs a lateral perforation for separating the reinforcement device and thereby accommodating the thickened lateral portion of corner block. Besides said lateral perforation the reinforcement device at its first end can have a perforated knock-out for accommodating an outdent in the cell of hollow masonry block.

The masonry reinforcement device of this invention can be used in conjunction with "Durowire", Block mesh, or Truss wire, etc. In that way there will be added bonding strength.

The prior art in order to reinforce block in a wall, poured cement inside the hollow block throughout the entire wall; filling entirely the hollow cells of the block with cement. This method of filling the hollow cells will employ a large quantity of cement and produce a wall of great weight, requiring strong and adequate foundation, as well as expensive support. The inventor has invented an improved light-weight masonry reinforcement device designed to eliminate the need to fill completely the cells of hollow block with cement to obtain the required strengthening of the wall. By using this improved light-weight masonry reinforcement device cement is saved and the need for expensive support is eliminated. In addition, it will be possible to use smaller size block and still attain adequate strength. The device is amenable for use in repair or patch work.

The main idea of the improved embodiment masonry reinforcement device conceived by the inventor is the use of light-weight material, e.g. plastic. One way in which the invention manages to use light-weight material in the device is by reinforcing the bottom surface of the trough. It is obvious that if light-weight material is not reinforced, the weight of cement placed in the trough will cause the trough to buckle and disengage from the block. Several factors will determine the amount of reinforcement required for the bottom surface of the trough. Among these factors are the amount of cement to be placed into the trough. It is obvious that if the trough is deep, more cement will be placed in the trough to bond adjacent courses of block. With more cement the bond between block will be stronger and, of course, the reinforcement would have to be made of a heavier weight material for stronger reinforcement of the trough. To eliminate the need for using heavier material, the inventor uses light material, but reinforces it using various structural modifications.

The light-weight material that the improved reinforcement device can be made of is preferably plastic, however, light-weight metal, cardboard or other sheet material would be operative. The important consideration is that the weight of the material be such that without reinforcement such as flanges, corrugations or side ribs, etc., the trough would buckle under the weight of the cement placed therein and the reinforcement device would come undone from the block.

In use the actual weight of the light-weight material will be determined by the amount and weight of cement to be placed in the trough. The weight and strength needed for the device can readily be determined by those skilled in the art and will fundamentally depend on the amount of cement put onto the tough. Several major advantages will accrue from the use of the inventive reinforcement device of this invention. Firstly, adequate keying will be accomplished using less cement. Because of improved keying and reinforcement, a smaller width block could be used to construct a wall. In addition, the device can be used with non-cement light-weight CMU's. Finally, by using less cement and a smaller block the foundation or supporting floors will not have to support as heavy a load and therefore they could be of lighter and less expensive in construction.

When concrete masonry blocks are partially filled using the masonry reinforcement of the invention the core mortar and the joint mortar solidify together as a unit. When the same method is used with truss-wire the core and joint area of mortar will harden above and below the wire reinforcement. Truss-wire or ladder-wire will be almost completely encased in mortar which is keyed inside the upper and lower courses of hollow block.

The reinforcement of this invention could be installed with almost all hollow CMU's used in masonry wall construction. Hollow 8" stretcher and corner block with square shaped cells are extensively manufactured in the United States. One type of trough conforms to these 8" concrete masonry units. A different size of trough can be installed with 6", 10" and 12" hollow CMU's.

There are various masonry accessories which have specific applications in block construction. The quantity of these accessories installed on each job site is relatively low. The reinforcement device of this invention can be utilized wherever hollow CMU's and truss or ladder-wire are used. It can be installed with most masonry anchors. In all these applications, the new device will provide substantial additional strength even when the hollow concrete masonry units are partially filled.

Masonry repairs are necessary in commercial and industrial buildings where door frames or openings in CMU walls are damaged. The new device is very useful with these and other repairs. For example, whenever block must be toothed-in and set under other block, there is no practical alternate means to fill the hollows. Door buck wire-ties or any fastener that penetrates an end-shell mortar joint should be used along with the reinforcement device.

The new device of this invention is easily installed. It aligns itself over hollow CMU's. A bundle of 150 units would be smaller than one 8" CMU. Because of its compatibility with conventional wire reinforcement, the masonry reinforcement device of this invention will become a device recommended by architects. Since it is versatile and compact, the device would be willingly used by masonry contractors.

An improved embodiment is contemplated by the inventor of this invention. The improved embodiment contemplates the use of light-weight material in fabricating the improved masonry reinforcement device. Light-weight sheet plastic would be ideal. However, in order to use light-weight sheet plastic, the sheet plastic has to be reinforced. This is so because unless the plastic is strengthened by reinforcement, the weight of the cement on the trough of the device will cause the masonry reinforcement device to buckle and detach itself from the top of the block.

Bearing in mind the need for strength and lightness of weight, the inventor has fashioned a masonry reinforcement device made of light-weight plastic, which is reinforced with side flanges to strengthen the light-weight sheet plastic so as to be able to adequately accommodate the weight of cement placed in the trough.

Light-weight plastic has several advantages over metal. For example, plastic can be of a weight lighter than metal. Plastic is easier to shape than metal. Of most importance is the fact that plastic will not corrode or rust to cause stains on the masonry wall. Note also that since plastic is generally non-reactive, it will not cause corrosion when coming in contact with metals such as in reinforcement bars or wire used in masonry construction.

The inventor contemplates other means for strengthening the trough of the masonry reinforcement device. For example, the bottom of the trough could be corrugated or accordion-pleated and made of flexible light-weight material. A trough made of corrugated material will have the advantage of strength as well as being able to butt against the side of the hollow cells to produce a snug-fit.

Another means contemplated for strengthening the trough is with rods or ribs molded or fitted along the bottom longitudinal edge of the trough. These stiffening rods or ribs could be made of extruded plastic with a longitudinal cut formed therein for fitting onto the trough. The plastic with the longitudinal cut could be placed over the edge of the trough to supply strength and to butt against the side of the hollow cell when the reinforcement device is set in place.

While the improved masonry reinforcement device has been described mainly in the context of a device used over a single hollow cell, it is readily apparent that it could be fashioned to fit over two or multiple cells as shown in FIGS. 10 and 11.

Note also that the improved reinforcement device can be fashioned with an outdent knock-out similar to that shown in FIGS. 10 and 11.

An elegant and unique embodiment of this invention involves a masonry reinforcement device which can be used with specially molded hollow block. This block would be manufactured with a ledge around the hollow cell of the block; usually toward the upper end of the cell parallel to the top of the cell. This ledge would be designed to hold a sheet of plastic or metal and form the base of the trough for receiving the cement. The ledge could be placed around the hollow cell of the block; or at only the two opposite sides of the cell. Of course, stiffened plastic or metal sheet as herein described could be used; that is sheet fabricated with stiffening flanges or corrugations. The ledge as described can be molded into the block; or a ledge substitute could be created by holes and pins placed in the hollow cell wall.

In the manufacture of masonry block the size of the hollow cell is not uniform from run-to-run and even within a run. This lack of uniformity is known in the art as accumulated tolerances. The improved embodiment masonry reinforcement device is designed to take up these accumulated tolerances. That is the device can be self-adjusted to fit the variance in the dimensions which result during the manufacture of the hollow cells in masonry block. This self-adjustment is accomplished by yieldably forming the bottom surface of the trough of the masonry reinforcing device with flanges, accordion pleats, corrugations or the like.

The improved masonry reinforcement device is one made of light-weight stiffened material and comprising a first end, a second end and an elongated surface between said first end and said second end. The first end and second end of said masonry reinforcing device being shaped to fit on the top first end and lateral wall in the center of said hollow masonry block, respectively. The elongated surface between said first end and said second end of the masonry reinforcing device defining a trough to be positioned over a single cell in said block with the bottom of said trough being modified by a means which stiffens the trough and allows cement to be placed therein without buckling the trough.

The means by which the bottom of the trough is stiffened are by side flanges, corrugations, accordion pleats, side ribs and like means which can be fashioned by those skilled in the art.

The improved masonry reinforcement device can be provided with a perforated knock-out to accommodate the outdent of a corner block.

The improved masonry reinforcement device can be used in a method for reinforcing masonry hollow block construction by setting the masonry reinforcement device between the courses of block and dropping mortar into the hollow core of a top block to land in the trough of the masonry reinforcement device to thereby vertically key the block set in the adjacent courses of block.

The improved masonry reinforcing device can be defined as being a light-weight stiffened material forming a trough having a top surface, a bottom surface, two opposite edges along the length thereof and two opposite edges along the width thereof. Said two opposite edges along the length having fixedly attached along said edges, a flexible flange projecting down and away from the top surface of said trough. Said two opposite edges along the width being provided with support members.

A special improved embodiment of this invention is hollow masonry block for receiving a masonry reinforcement device comprising a block having at least one hollow cell having a top surface and an inside surface which is provided with a ledge running on said inside surface and running below and substantially parallel to the top surface of said hollow cell. Said ledge providing support for a masonry reinforcement device such that when the masonry reinforcement device is positioned over the ledge in the exposed hollow cell of the hollow masonry block in a bottom course of hollow block, and a top course of hollow masonry block is set over the block in the bottom course of block and an adequate amount of mortar dropped into the exposed hollow cells of the top masonry block, the dropped mortar will land in said masonry reinforcement device to bind and adhere the interior hollow cell surfaces of both the bottom hollow block and the top hollow block and thereby form a secure bond between the blocks.

For clarity of illustration, the mortar has been omitted from between the blocks depicted in FIGS. 1, 3–5, 7 and 9; and in FIGS. 1, 3, 4, 8, 9 and 11, the broken lines indicate the placement of the reinforcement device onto the hollow block.

Figure 13:
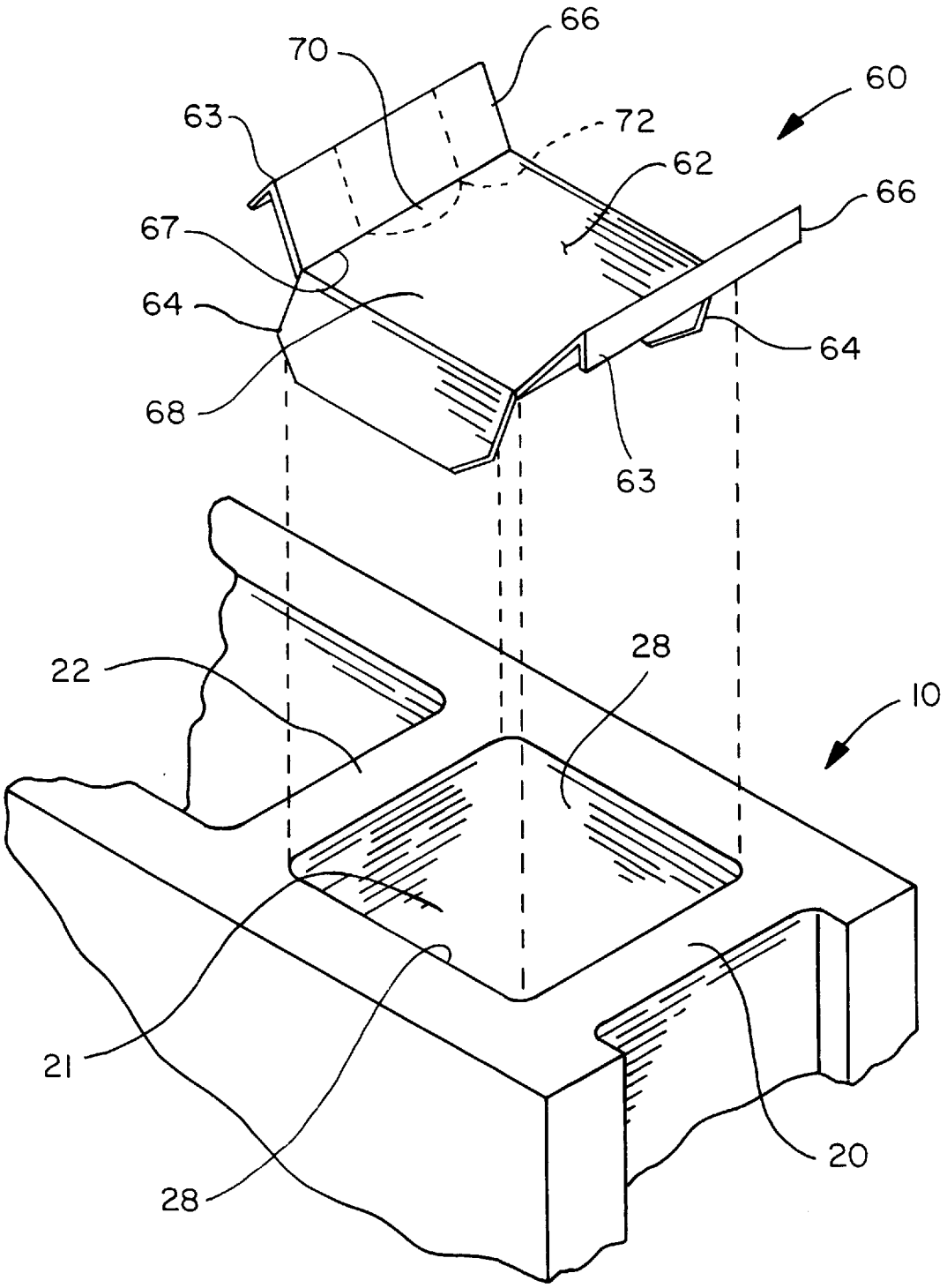

FIG. 13 is a perspective view of the improved masonry reinforcement device. The dashed lines show how it will be inserted into the cell of the block.

Figure 14:
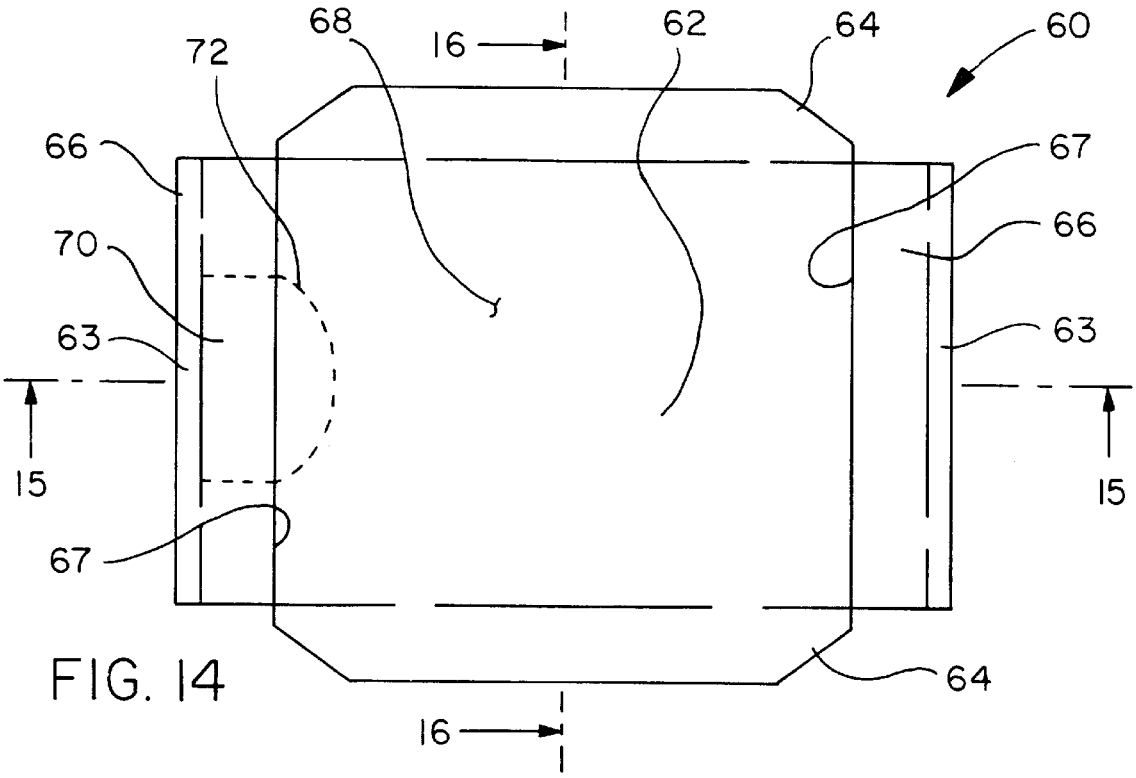

FIG. 14 is a top plan view of the improved masonry reinforcement device.

Figure 15:
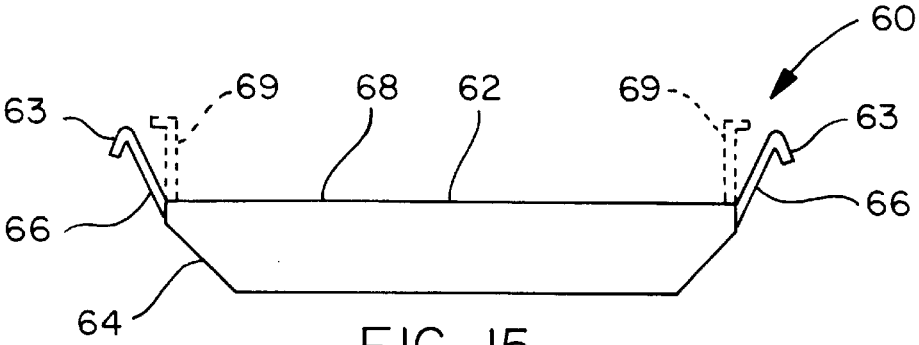

FIG. 15 is a section taken along lines 15—15 of FIG. 14. The dashed lines show the flexing of the support members.

Figure 16:
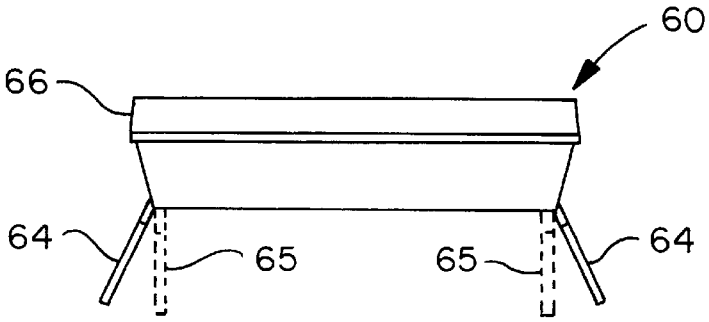

FIG. 16 is a section taken along lines 16—16 of FIG. 14. The dashed lines show the flexing of the bottom flange.

FIGS. 17A–21B are schematic representations of how the improved masonry reinforcement device is to be applied to the hollow cell for reinforcement of the courses of block. The side wall and end wall of the block have been removed to show the placement of the reinforcement in the cell. The vertical lines define the cell.

Figure 17B:
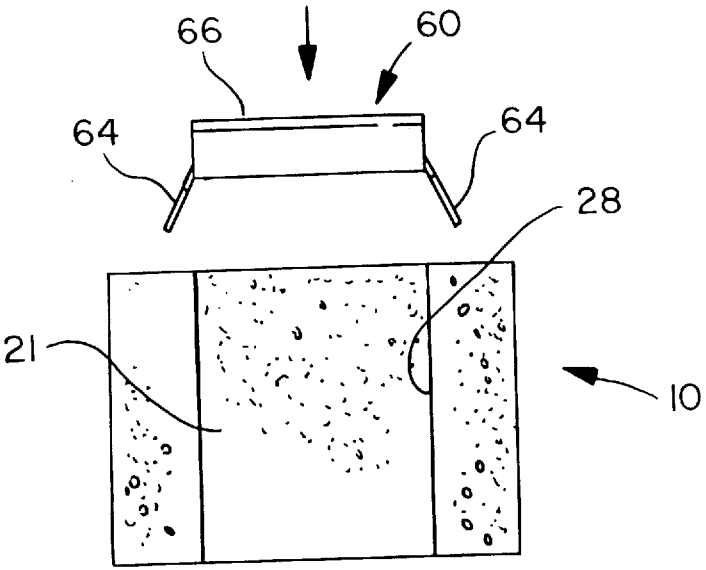
Figure 17A:
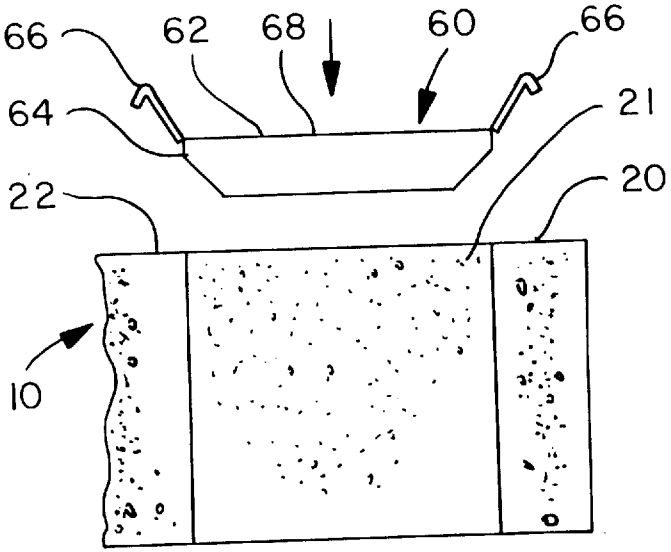

FIG. 17A is a side view of the masonry reinforcement device about to be inserted into a cell of a masonry block. Part of the left side of the block has been broken away for the ease of illustration.

FIG. 17B is an end view thereof.

Figure 18B:
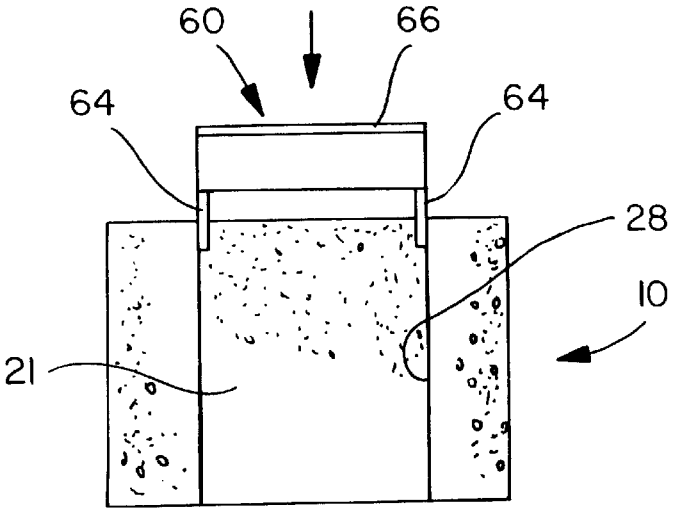
Figure 18A:
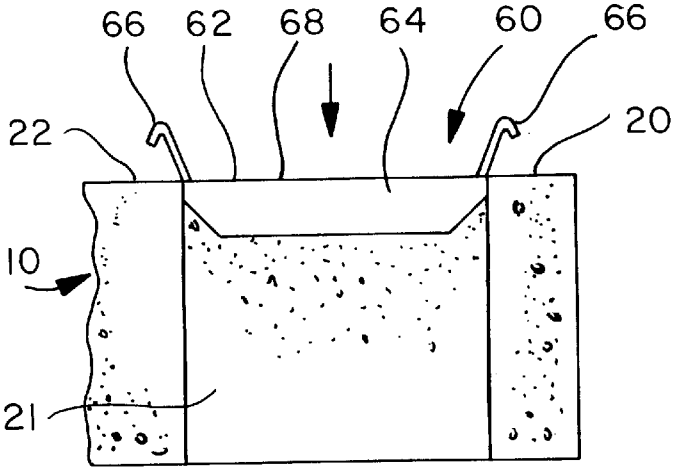

FIG. 18A is a side view of the masonry reinforcement device partially inserted into the cell of the masonry block. Part of the left side of the block has been broken away for ease of illustration.

FIG. 18B is an end view thereof.

Figure 19B:
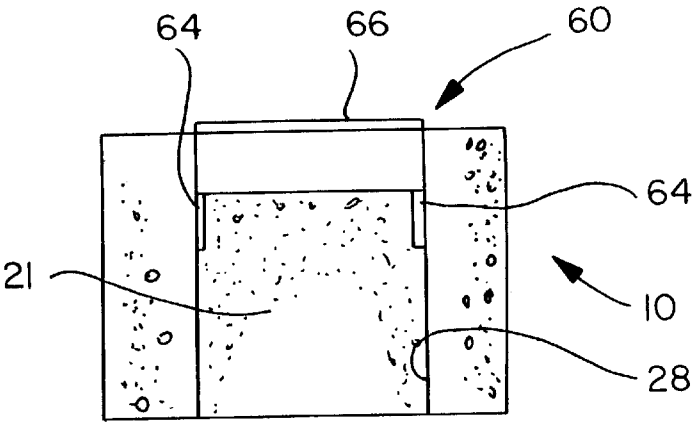
Figure 19A:
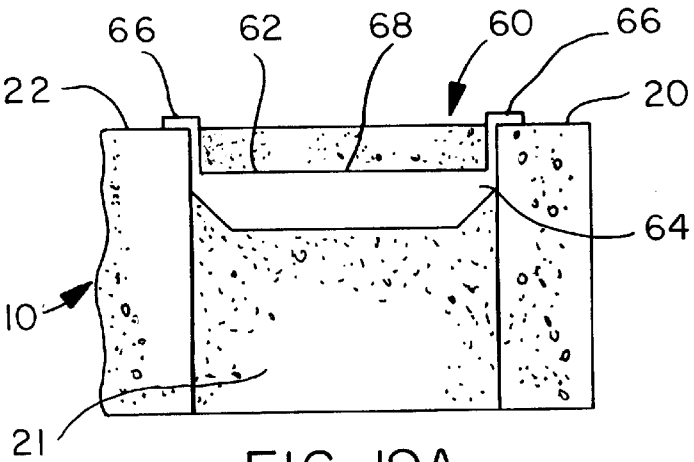

FIG. 19A is a side view of the masonry reinforcement device fully inserted. Part of the left side of the block has been broken away.

FIG. 19B is an end view of masonry block with the reinforcement device fully inserted.

Figure 20B:
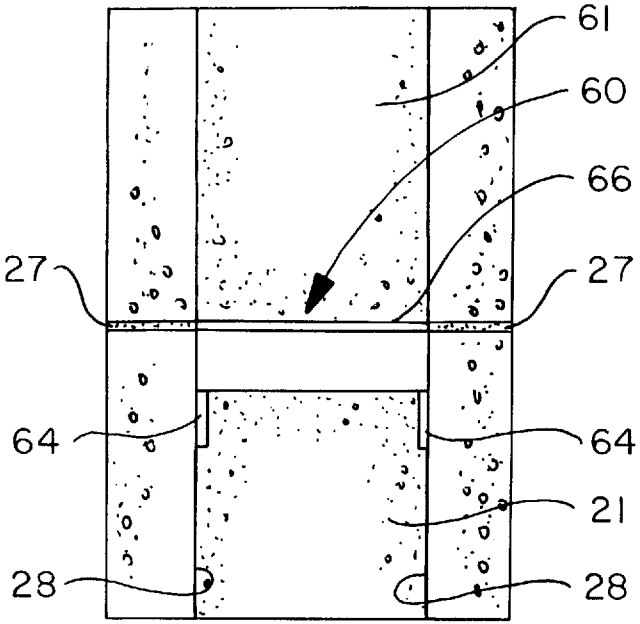
Figure 20A:
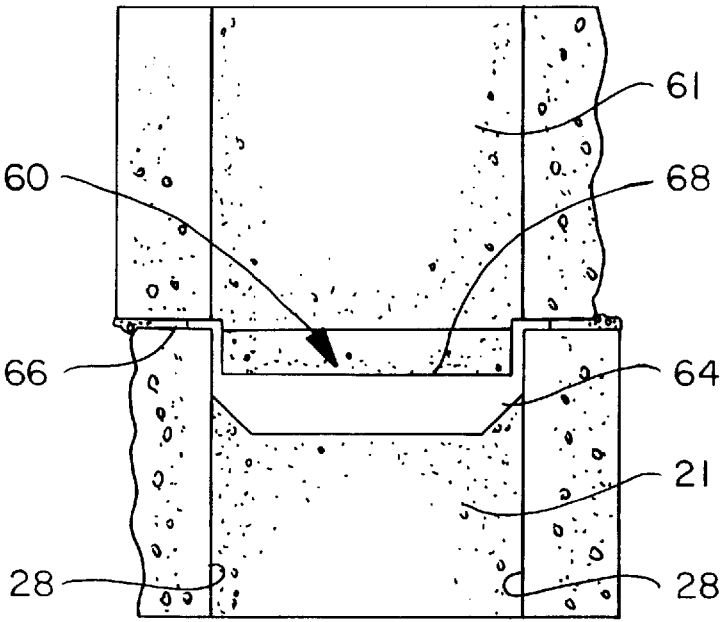

FIG. 20A is an end view of one masonry block set over another block with the reinforcement device there between. The right side of the top block and the left side of the bottom block have been broken away for ease of illustration.

FIG. 20B is an end view thereof.

Figure 21B:
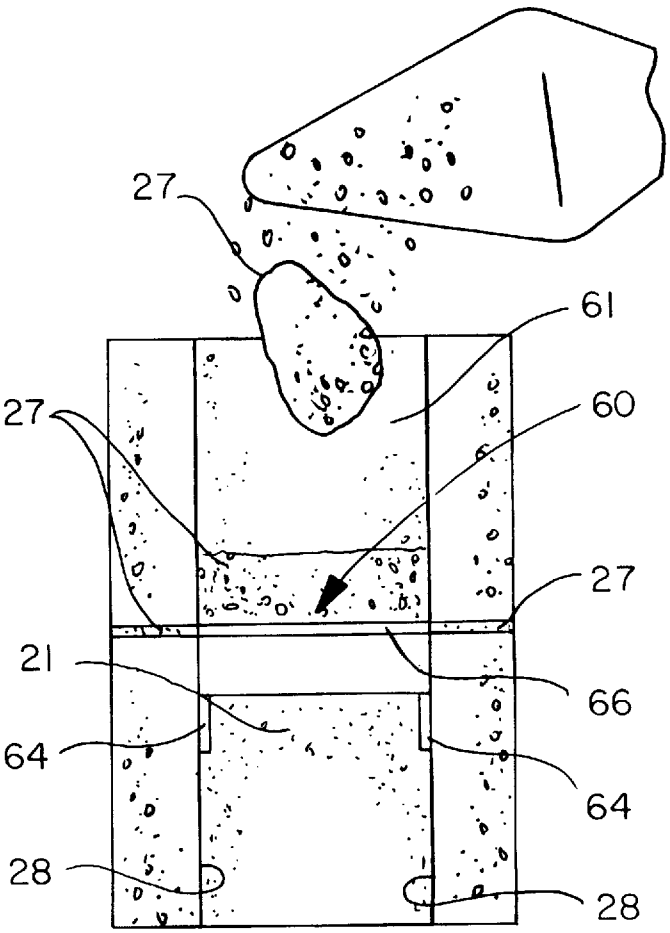
Figure 21A:
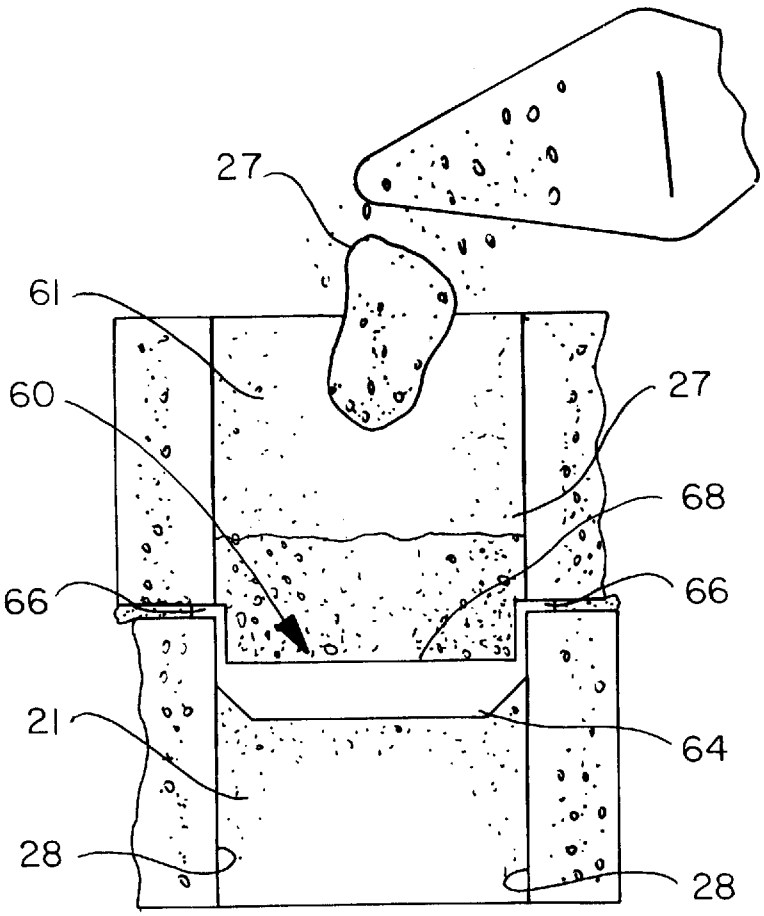

FIG. 21A is a side view of one masonry block set over another block with cement having been dropped into the cell for keying the top block to the bottom block. The right side of the top block and the left side of the bottom block have been broken away for ease of illustration.

FIG. 21B is an end view thereof.

Figure 22:
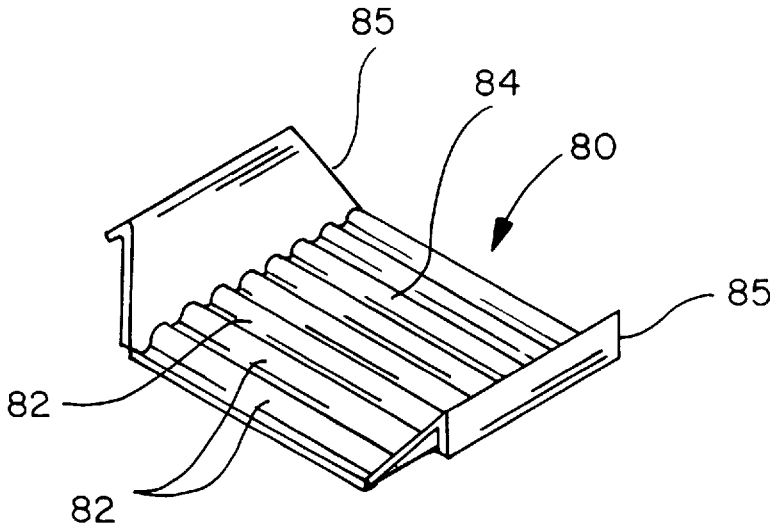

FIG. 22 is a perspective view of an alternate embodiment of the improved masonry reinforcement device with corrugations serving as the bottom of the trough.

Figure 23:
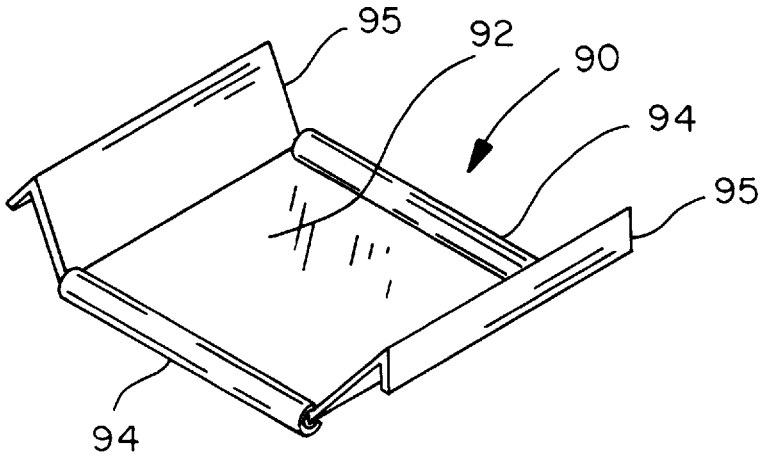

FIG. 23 is a perspective view of another alternative embodiment of the improved masonry reinforcement device with rib-edge bracing for the longitudinal edge of the trough.

Figure 24:
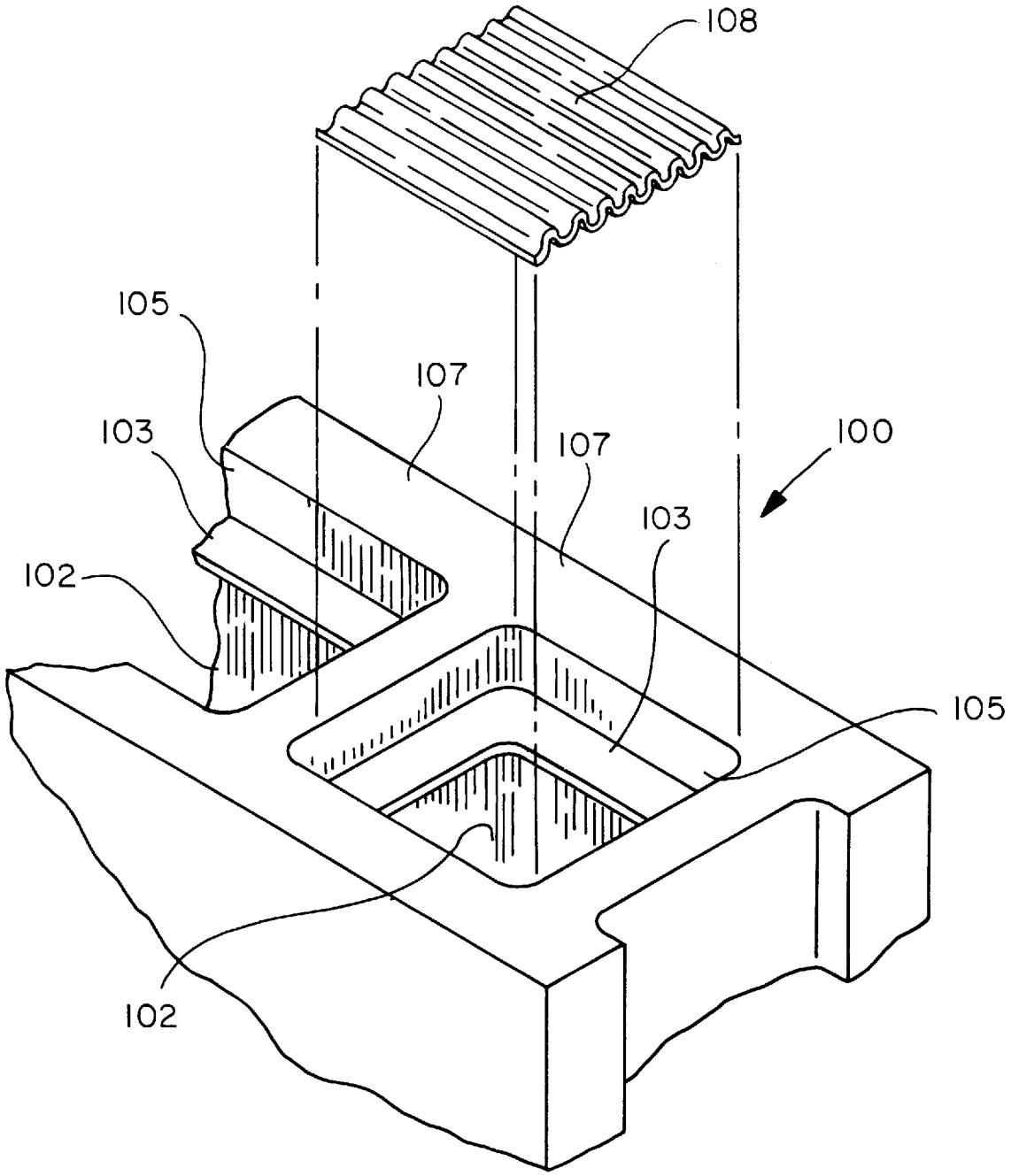

FIG. 24 is a perspective view of a modified block with a ridge to support a corrugated sheet to form a trough.

GENERAL DESCRIPTIONS OF THE PREFERRED EMBODIMENTS

Figure 1:
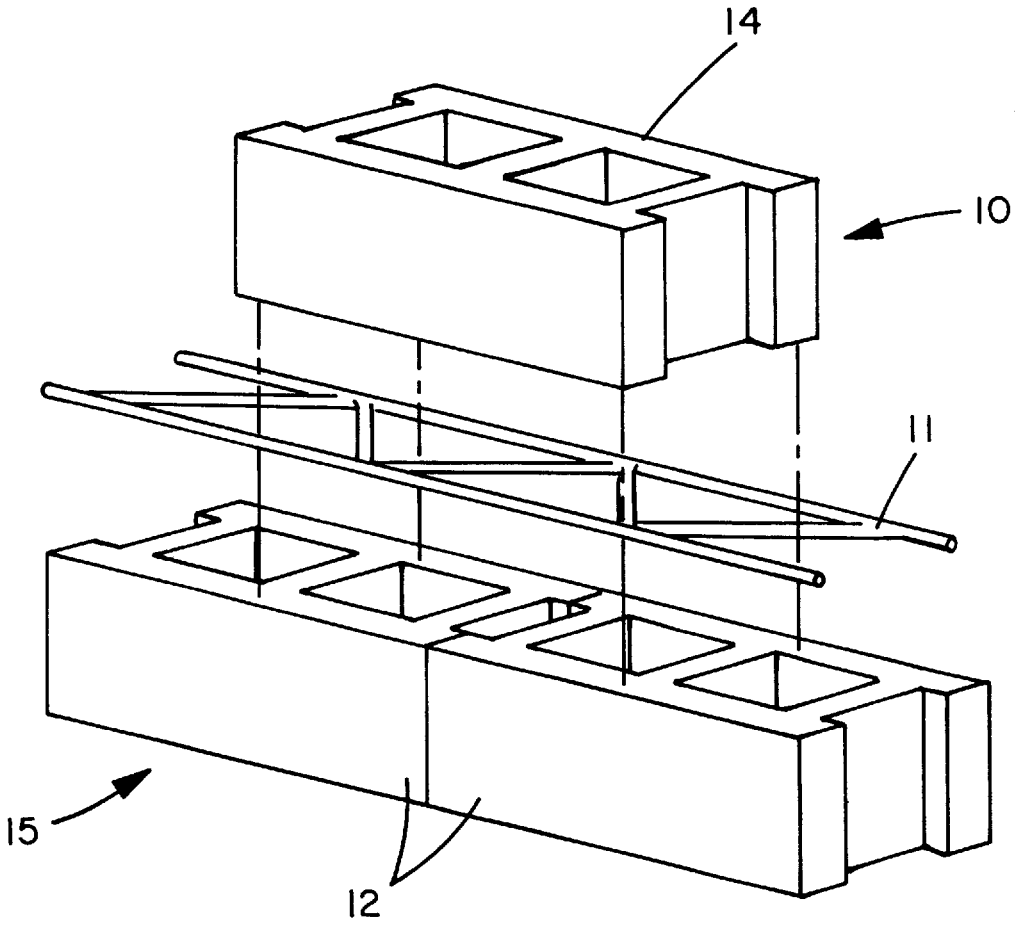
FIG. 1 PRIOR ART
FIG. 1 is a perspective view illustrating the prior art method employed for reinforcing hollow block memory construction.

With reference to FIG. 1, the prior art method of bonding hollow block 10 uses "Durowire" 11, Truss wire or Block mesh between the courses of block 10 for strengthening. This method strengthens horizontal, block to block bonding 12 in a given course, but does not substantially strengthen vertical bonding. It is noted that top block 14 is in a offset relationship relative to the blocks of the bottom 15 course. This offset relationship of block 10 serves to strengthen the wall 17 (shown in detail in FIG. 7).

Figure 2:
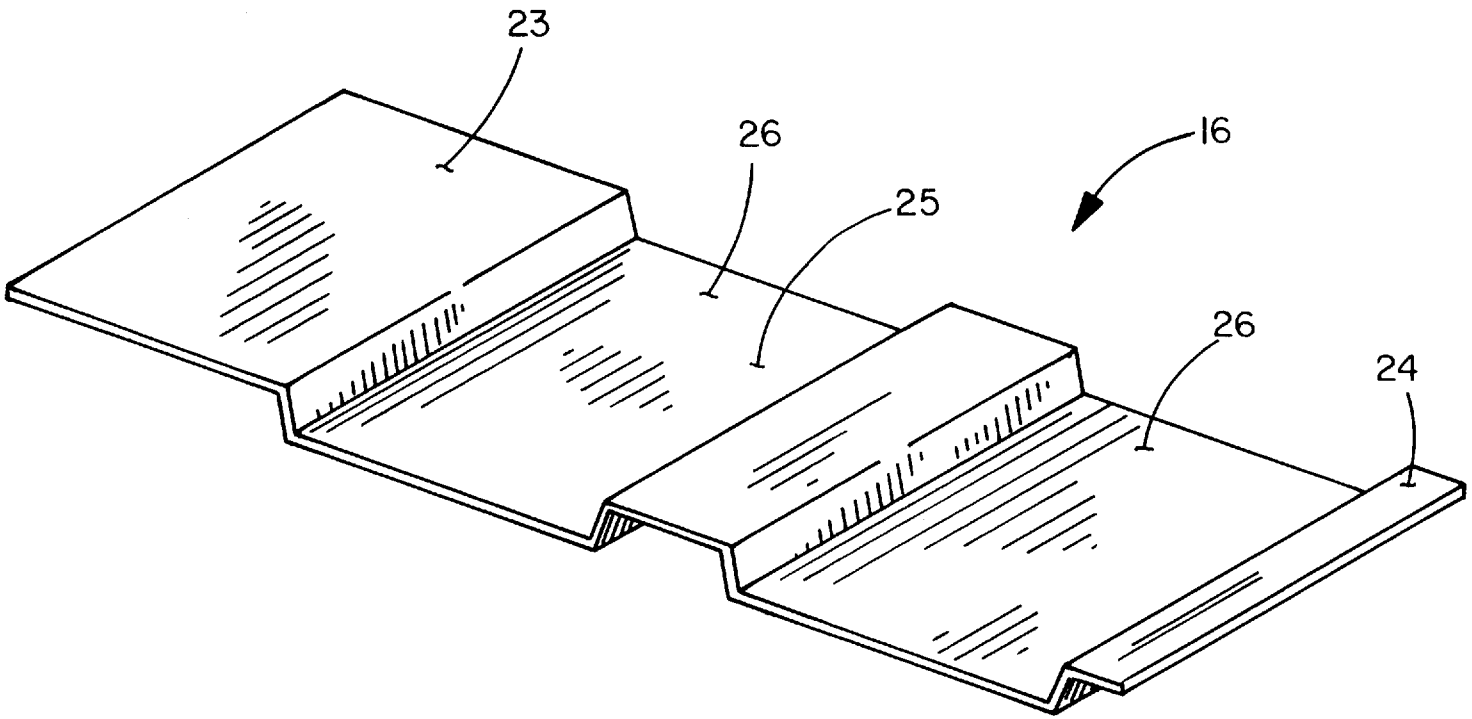
FIG. 2 is a perspective view illustrating the masonry reinforcement device of this invention.
Figure 3:
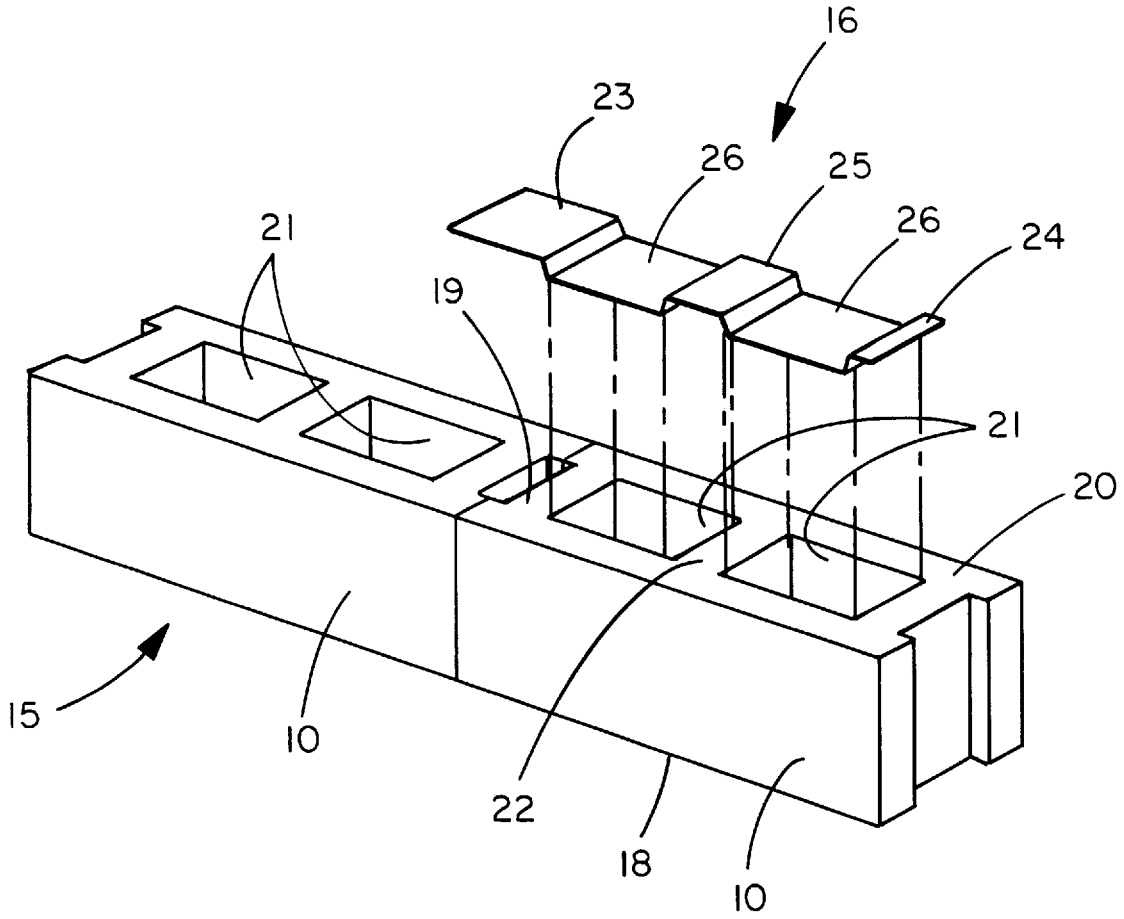
FIG. 3 is a perspective view illustrating the masonry reinforcement device of this invention as it would be applied to masonry hollow block for reinforcement.
Figure 4:
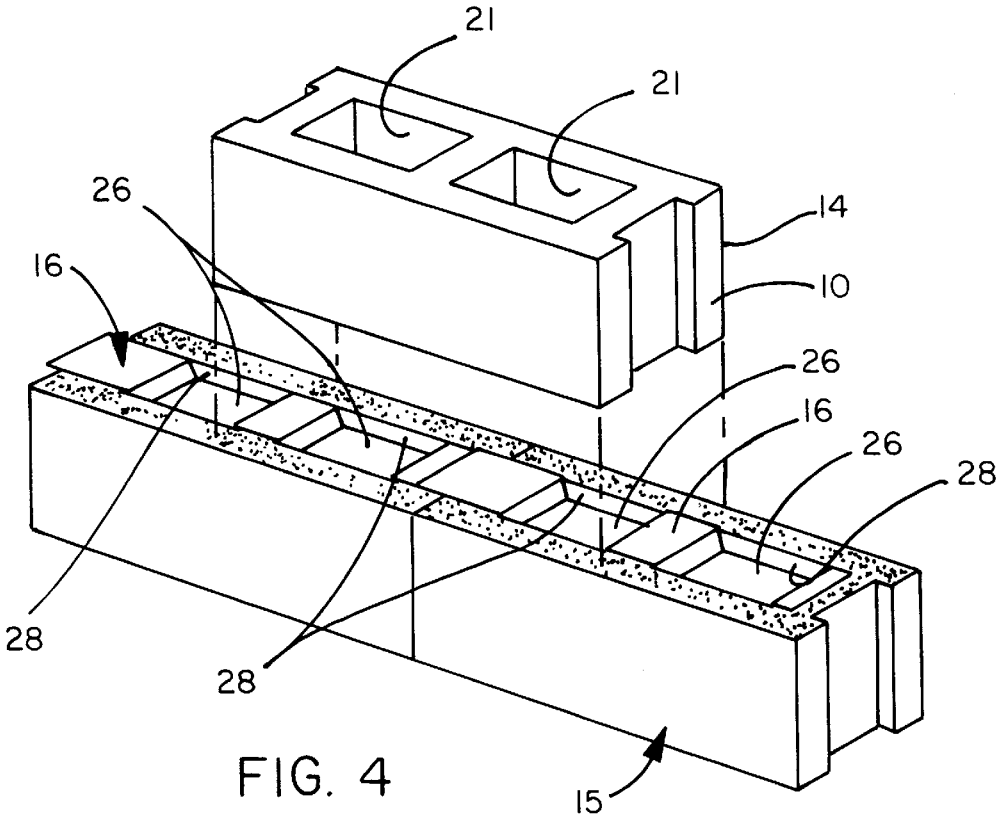
FIG. 4 is a perspective view illustrating the application of a hollow block over the set reinforcement device.
Figure 5:
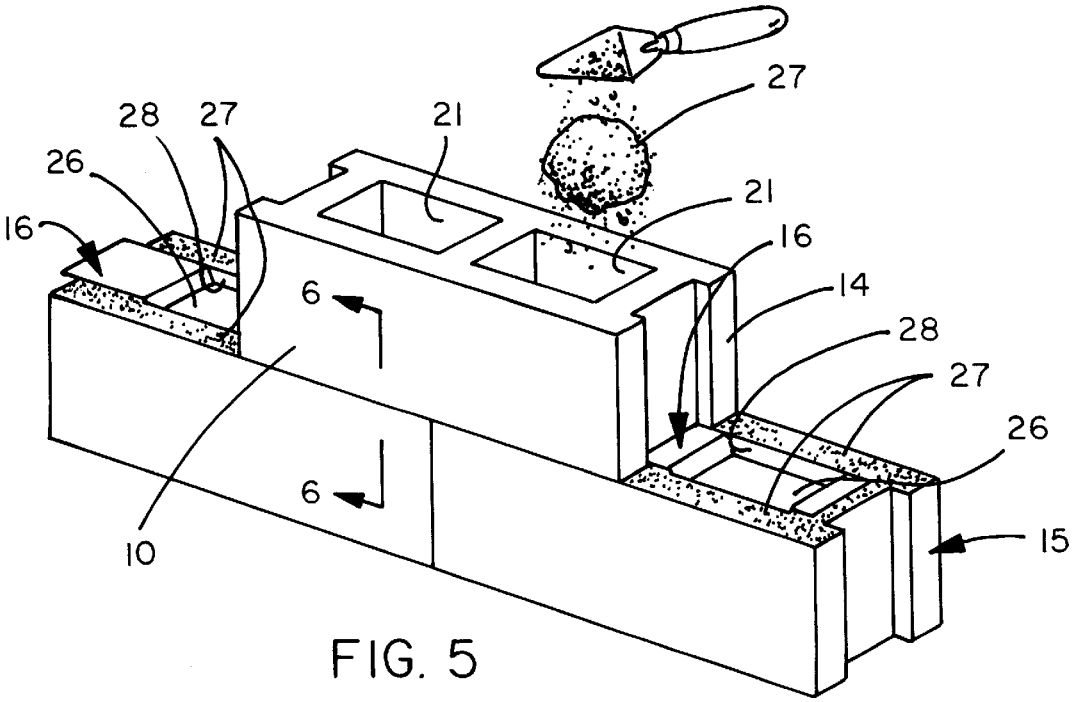
FIG. 5 is a perspective view illustrating dropping mortar into the hollow of the block with the reinforcement in place.
Figure 6:
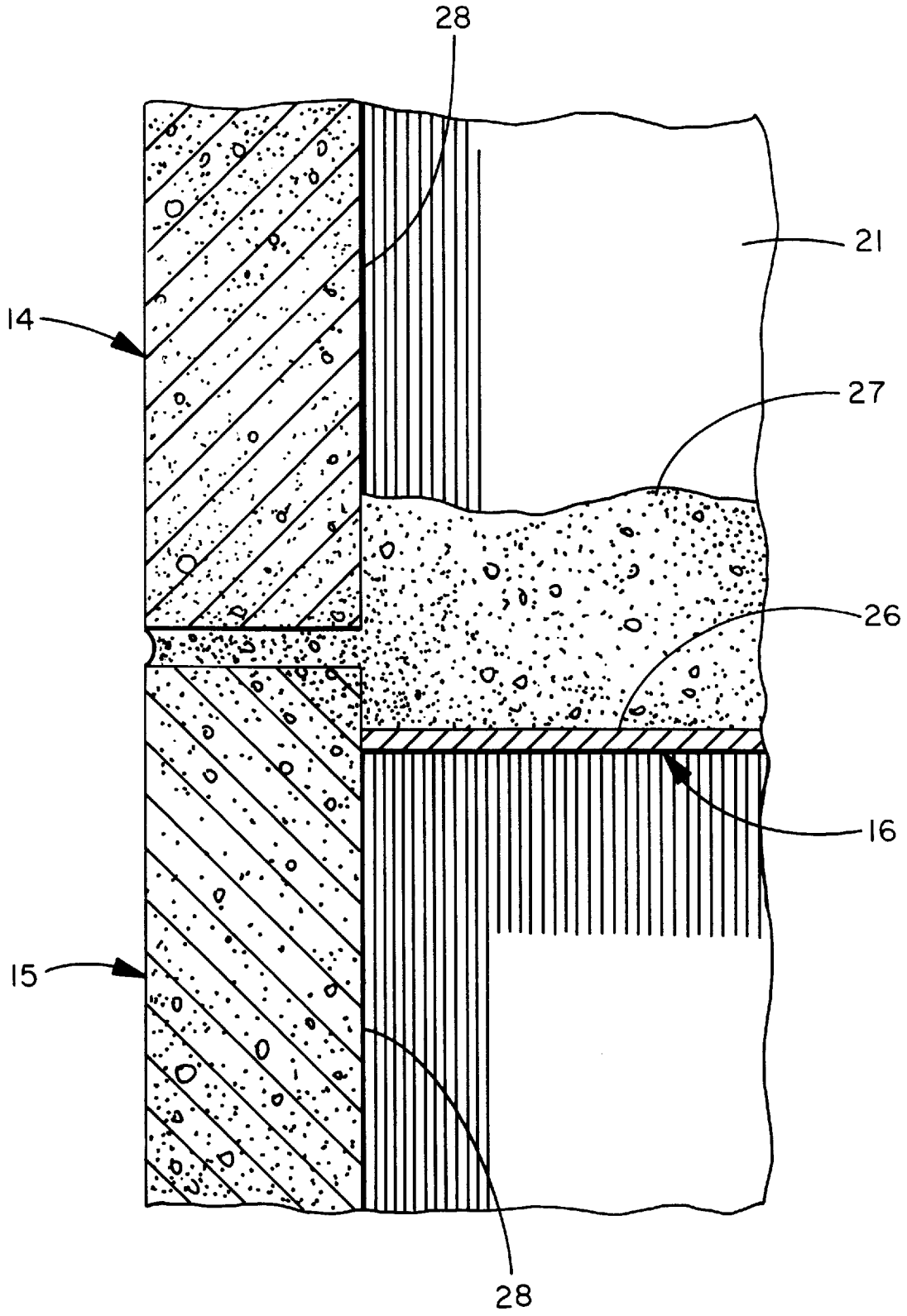
FIG. 6 is a cross-sectional view taken along lines 6—6 of FIG. 5, showing the second course of block with the reinforcement in place and mortar, dropped in the trough, and binding the top and bottom blocks to one another.

The masonry reinforcement device 16 of this invention (FIG. 2) is placed over a block 10 laid in a first or bottom course of block 15 (FIG. 3). The dashed lines show the final positioning of the masonry reinforcement device 16 over the hollow block 10. The hollow block 10 has a rectangular configuration 18, a top first end 19, a top second end 20 and two exposed hollow cells 21 formed by a lateral wall 22 in the center of the hollow block 10. The masonry reinforcement device 16 has a first end 23, a second end 24, and an elongated surface 25 between said first end 23 and the second end 24 of the reinforcement device. The first end 23 and second end 24 of the masonry reinforcement device 16 is shaped to fit on the top of the first end 19 and top second end 20 of the hollow block 10, respectively. The elongated surface 25 between the first end 23 and second end 24 of the masonry reinforcement device 16 is shaped to define two troughs 26 to be positioned over the two exposed hollow cells 21 and lateral wall 22. Once the masonry reinforcement device 16 is set in place (FIG. 4) and mortar 27 dropped into the exposed hollow of the cell 21 of the top block 14 (FIG. 5), the mortar 27 will land onto the trough 26 under the hollow of top cell 21 (FIG. 5 and 6) and bind and adhere to the interior cell surfaces 28 of both the bottom 15 and top block 14.

The amount of mortar 27 to be dropped into the top of the hollow cell 21 can vary. Ordinarily, a half of a trowelful will be adequate to provide keying and binding of the blocks 10. Of course, the more mortar added to the cell the greater will be the binding. Ordinarily, about a quarter to three-quarters of an inch of mortar on the inner surfaces of each of the top and bottom blocks of a course will provide adequate binding.

The plate or strip 16 is dimensioned so as to fit easily into the top of the hollow cell 21. Some convenient directional movement or float of the trough 26 within the hollow 21 is desirable because of variety of dimensions of the concrete masonry units or hollow block 10. The masonry reinforcement device 16 would present no problems for running electric wires or conduit because these are generally run on the outside of the wall. Nevertheless, the reinforcement device 16 could be easily cut and shaped to accommodate any internal wire or conduit.

The masonry reinforcement, device or strip 16 can be made of a variety of materials, such as for example, metal or plastic. Neither the metal or plastic has to be specially surface treated, e.g., galvanized. The only important consideration is that the strip 16 be strong enough to hold mortar in the trough. For example, thirty to twenty four gauge metal would be acceptable. The sturdiness of the material making the masonry reinforcement will ultimately depend upon the amount of binding mortar placed into the trough. It is theoretically possible to use a sheet of flexible material, such as a mesh, as the reinforcement, and have the weight of the applied mortar form the trough. It is visualized that the strip 16 would be supplied nested in packages, of one hundred strips, more or less, based on convenience. This type of packaging would make shipping and inventory control easy. As a further note, the most expedient method for manufacturing the strip 16 would be stamping from a roll of sheet metal.

Figure 7:
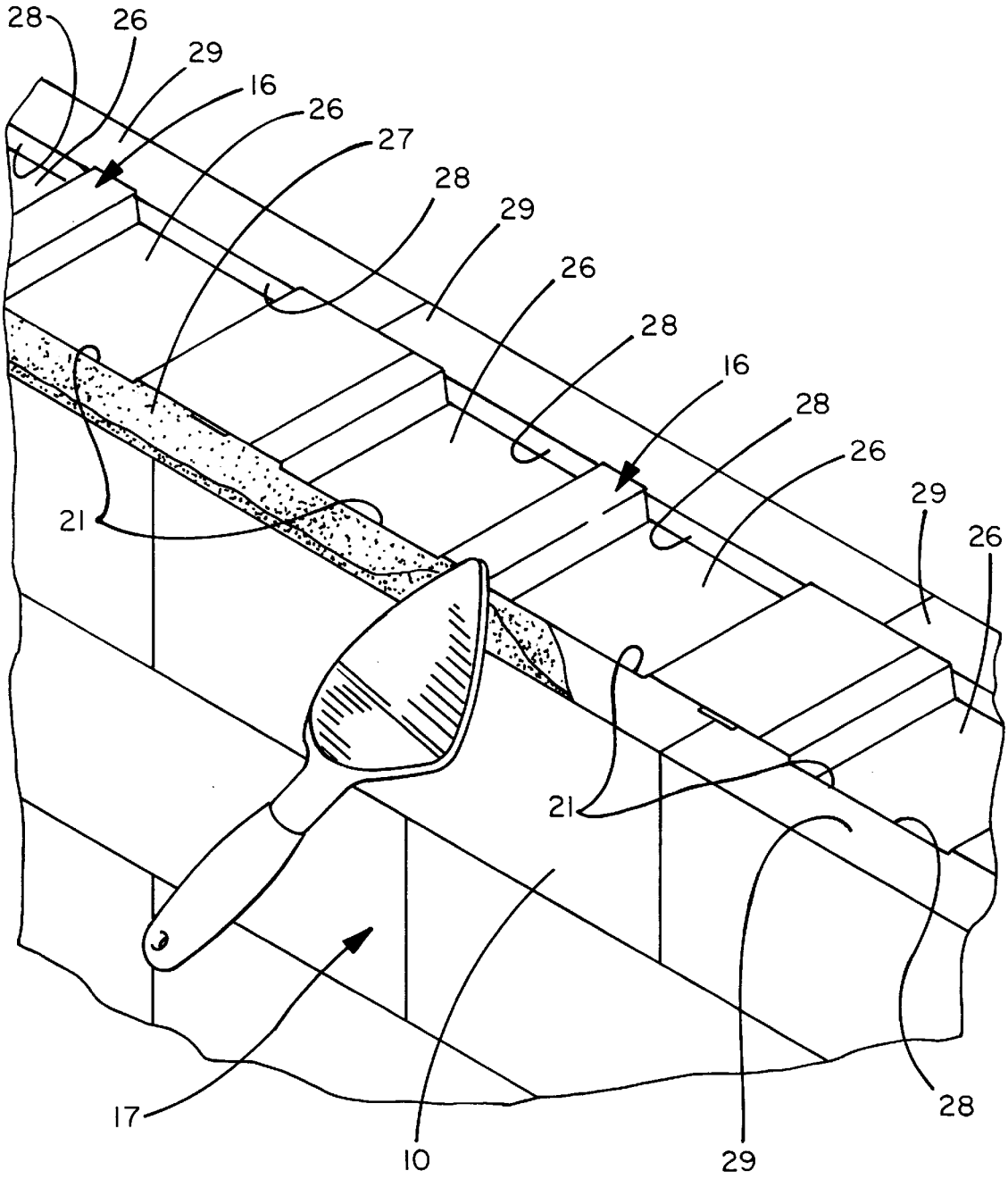
FIG. 7 is a view illustrating the application of mortar to the top edges of the hollow block set in a wall with the reinforcement device in place.
Figure 8:
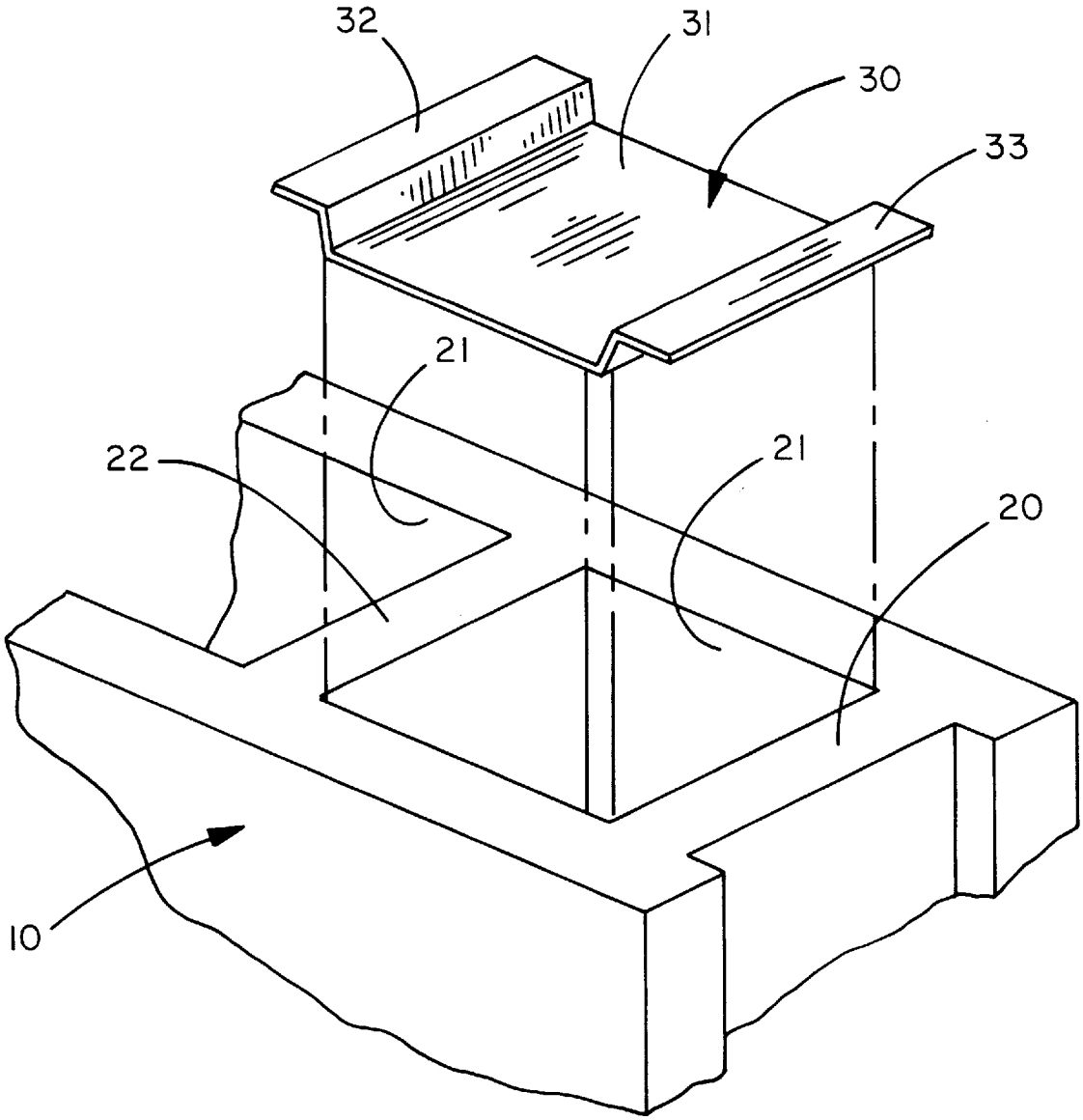
FIG. 8 is a view illustrating an alternative embodiment of the masonry reinforcement device designed cover a single hollow cell.

Hollow block 10 construction employing the reinforcement strip 16 between the courses of block 14 and 15 is continued until the wall 17 is completed. (FIG. 7). The CMU or block 10 is laid so that the blocks 10 in each course are staggered, that is, a bottom block only abuts half of a top block.

Note that with the reinforcement device 16 in place, before mortar 27 is applied to the top edge 29 of the block 10, mortar 27, which would ordinarily drop in the hollows 21 and be lost, is now caught in the trough 26 and becomes part of that mortar 27 which binds the interior of surfaces 28 of the block 10 (FIG. 7).

The masonry reinforcement device or strip 16 of this invention has alternative embodiments. For example, besides the masonry reinforcement strip 16 having two troughs 26 as exemplified in FIGS. 2 and 3, the reinforcement 30 can have a single trough 31 (FIG. 8) with a first end 32, second end 33 to fit over an end wall 20, and lateral dividing wall 22, respectively, as well as the hollow cell 21 of the block 10. The single trough 31 is placed between end 20 and lateral wall 22 and fits into the top of the hollow cell 21 to catch the mortar 27 dropped into the top of the cell 21 of a top block 10 (not shown) and to land onto the trough 31.

Figure 9:
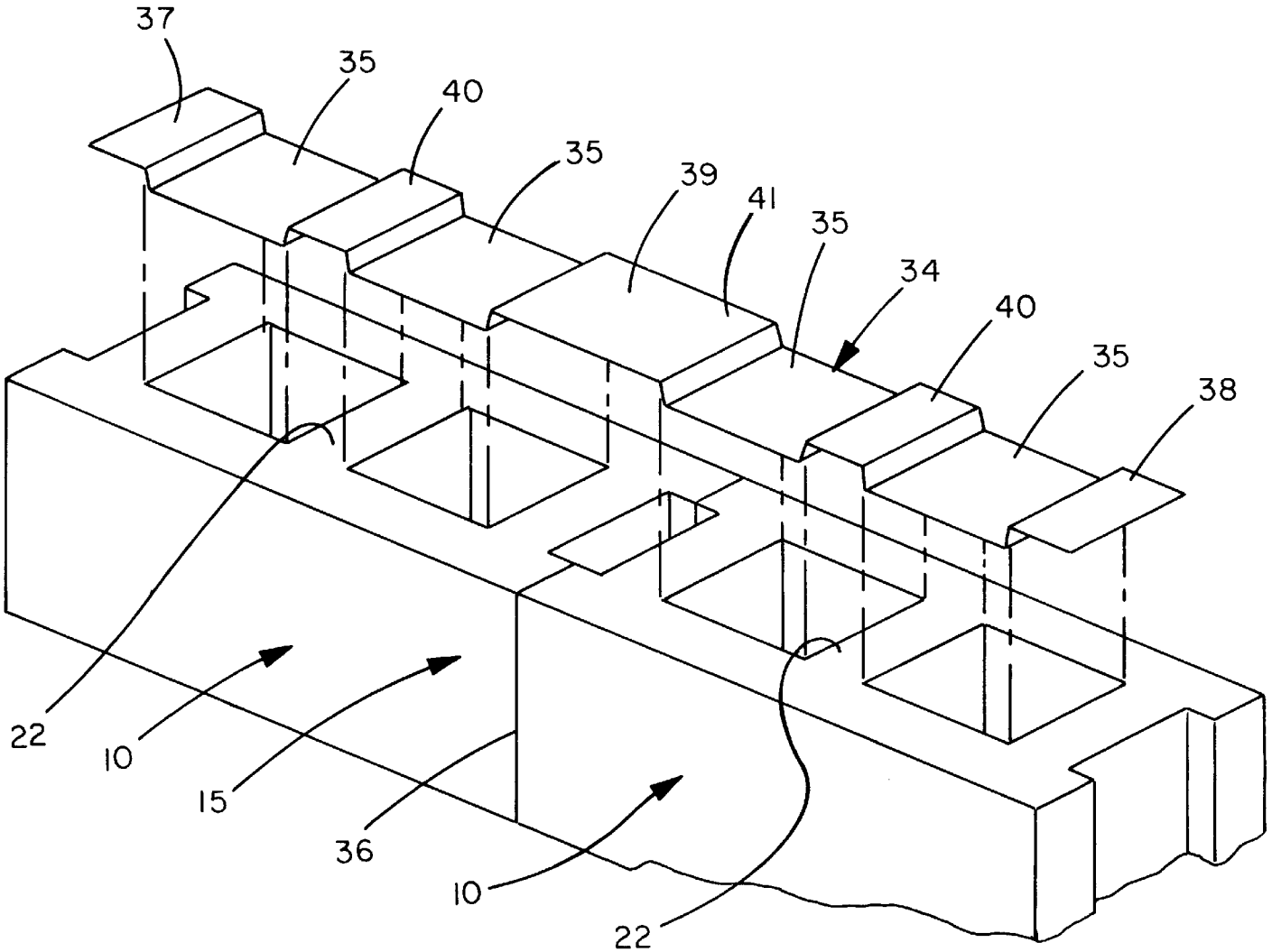
FIG. 9 is a view illustrating an alternative embodiment thereof designed to cover the hollow cells and form troughs over two blocks.

A further embodiment of this invention is a masonry reinforcement device 34 with several troughs 35 (FIG. 9). This masonry reinforcement 34 with the several troughs 35 is designed to fit over two butting ends 36 of horizontal masonry blocks 10 set in a course 15. The reinforcement device with several troughs 34 has a first end 37, a remote second end 38 and several troughs 35. The elongated portion 39 between the two ends 37, 38 has portions 40 shaped to fit over the lateral dividing wall 22 of the hollow block 10 and a lengthened portion 41 to fit over the two butting ends 36 of adjacent block 10. While it is possible to extend the masonry reinforcement beyond that exemplified in FIG. 9, it would not be practical. This is so because with the variance in the width of the mortar joints in the courses of block, the lengthened reinforcement device may not be able to be fitted properly into position.

Figure 10:
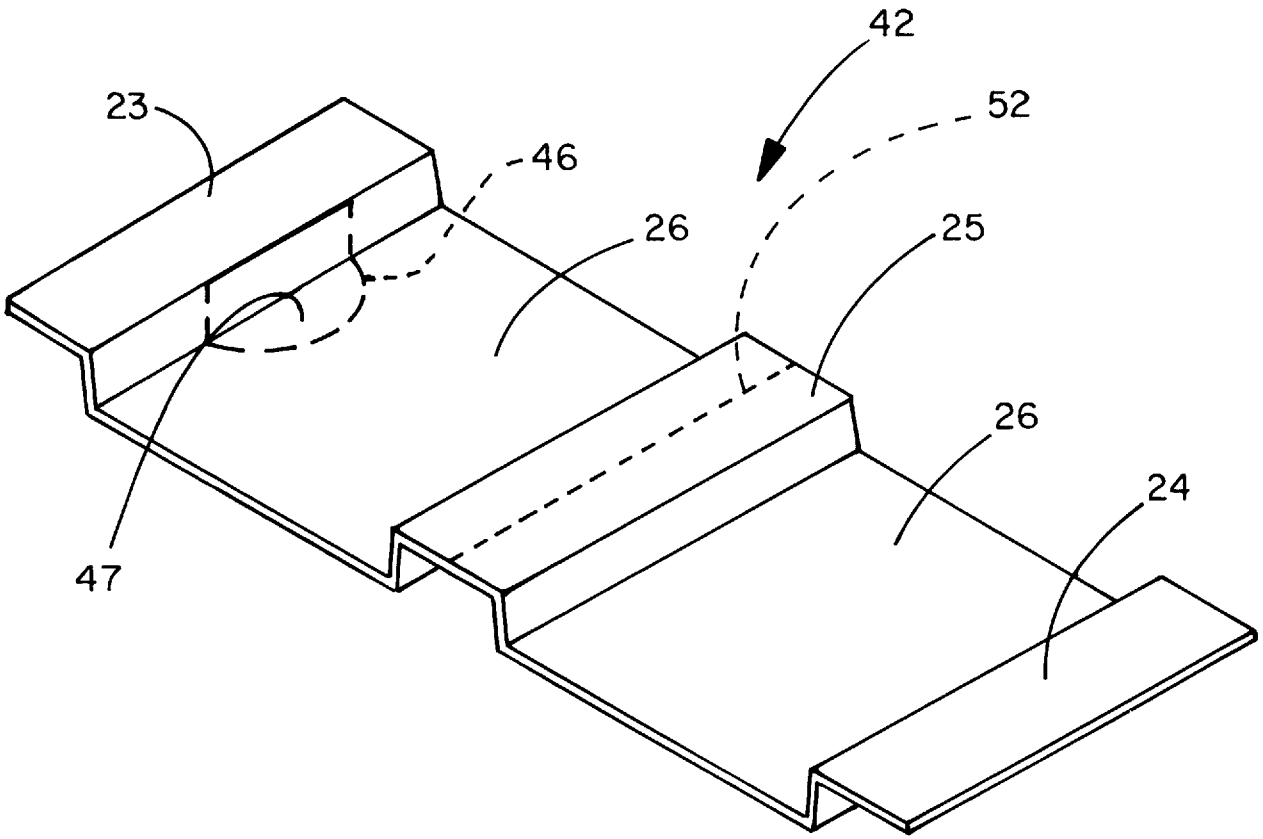
FIG. 10 is a view illustrating the masonry reinforcement device with the attached perforated knock-out for the outdent of the corner block and a lateral perforation.
Figure 11:
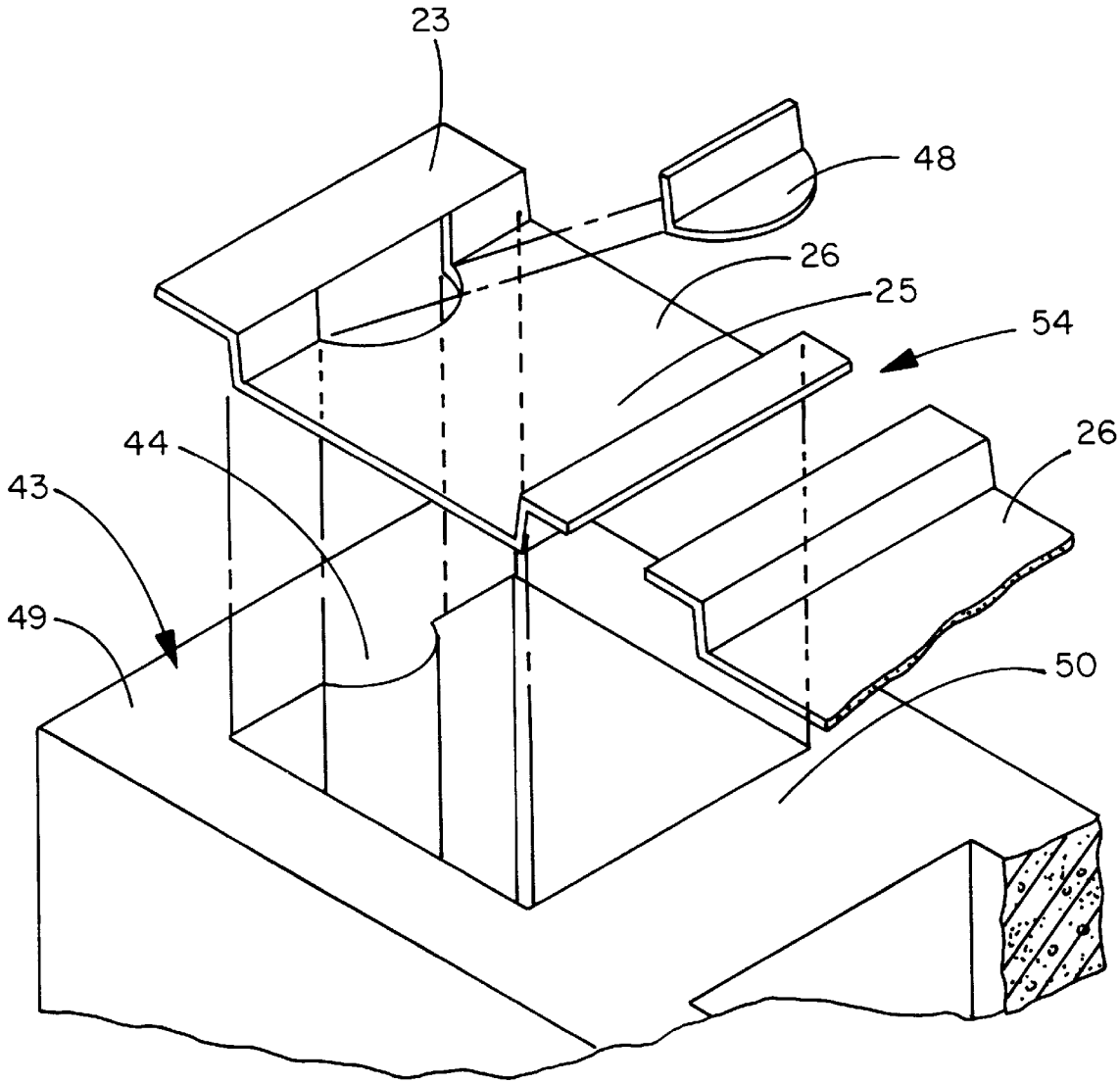
FIG. 11 is a view illustrating a separated masonry reinforcement device with the outdent knock-out removed; part of the reinforcement device is broken away.

With reference to FIGS. 10–11, there is shown a masonry reinforcement device 42 for accommodating hollow masonry block 43 with an outdent 44, Block 43 with an outdent 44 is generally found in corner block described above. The reinforcement 42 (FIG. 10) is supplied with a perforated 46 knock-out 47 for removing the semicircle tab 48 (FIG. 11) in the reinforcement device 42, and perforations 52 for dividing the reinforcement device. Note that with reference to FIG. 11 the center lateral dividing wall 50 of the corner block 43 is wider than the center wall of stretcher block 10 (2½" vs. 1¼"). Perforations 52 or break points allow for the reinforcement device 42 to be severed 54 to accommodate the wider center lateral dividing wall 50 of the corner block 43. Of course a reinforcement device with a wider elongated surface for fitting over the wider center lateral dividing wall 50 can be made. However, supplying reinforcement devices with perforations 52 or break points will reduce the need for manufacturing and supplying multiple reinforcements. Once the semicircle tab 48 is removed and center perforation 52 broken, the reinforcement 42 will fit over the outdent 44, of the corner block 45 and over thickened center lateral dividing wall 50 in the center of the corner block 43.

The reinforcement device 42 for accommodating the outdent 44 has ends 23, 24 troughs 26 and a elongated portion 25 forming the troughs 26 and perforations 52 which can be severed for accommodating the wider center lateral dividing wall 50 of the corner block 43, or can be used unsevered on the stretcher block.

Figure 12:
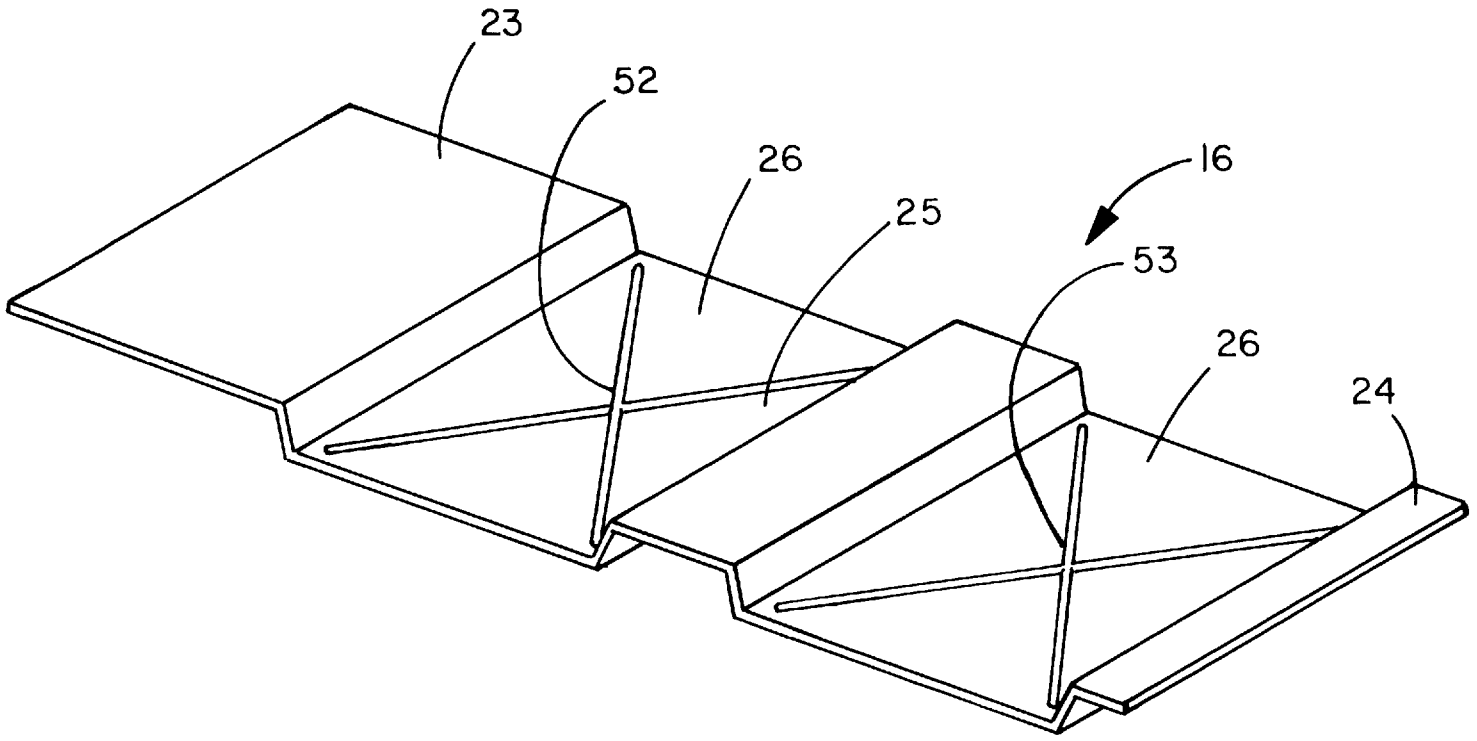
FIG. 12 is a top perspective view of an alternative embodiment of the masonry reinforcement device with a reinforced trough.

As unique embodiments of this invention, the flat bottom of the trough 26 could be modified. One modification envisions the bottom of the trough 26, instead of being flat, would have reinforcing ribs 53 (FIG. 12). The trough 26 instead of having a ribs 52 at the bottom could be bent for reinforcement and have a pyramid or a truncated pyramid configuration. The pyramid configuration would strengthen the trough 26, as well as, save mortar dropped into the hollow cell. A further modification of the flat trough bottom envisions parallel corrugations, which would supply strength to the trough.

Referring to FIG. 13, an improved masonry reinforcement device 60 is set above a hollow cell 21 of a masonry block 10 prior to insertion. The dashed lines show the direction for the placement of the reinforcement device 60 in the hollow cell 21.

With regard to FIGS. 13–16 the improved masonry reinforcement device 60 has a flat trough surface 62 bottom longitudinal reinforcing flanges 64 and side support members 66 along the width ends 67 of the trough 68. Support members 66 have been provided to rest the improved masonry reinforcement device 60 on the top ends 20 and 22 of the block 10. (FIG. 13) Support 66 is flexible projecting away from the trough surface and has a flanges 63 which rest on top of cell walls 20 and 22.

An outdent knock-out 70 shown by perforated lines 72 is provided in the reinforcement device to accommodate the outdent 44 of a corner block 43, said block with an outdent is shown in FIG. 11.

In FIG. 15 the dashed lines 69 illustrate how the support member 66 will flex when the device 60 is inserted; and in FIG. 16 the dashed lines 65 illustrate how the bottom flange members 64 will flex when they are inserted into the cell 21.

FIGS. 17A–21B schematically describe the placement of the improved masonry reinforcement device 60 in the hollow of a cell 21. The device is placed above the block 10 (17A and 17B) prior to insertion into the top of the hollow cell 21; next (FIGS. 18A and 18B) the improved masonry reinforcement device 60 is partially inserted into the cell of the block 10 and then fully inserted into the cell 21 (FIGS. 19A and 19B). Once the improved masonry reinforcement device 60 is in place and a top block 61 is placed thereon (FIGS. 20A and 20B) cement 27 can be placed in trough 68 (FIGS. 21A and 21B) to secure block 10 in a bottom course to block 61 in a top course.

Modifications of the improved masonry reinforcement device 60 are contemplated by the inventor. Referring to FIG. 22, the inventor proposes a device 80 with corrugated reinforcement 82. Instead of strengthening the bottom of the trough surface 84 with flanges 64 a corrugated bottom surface 82 is provided. The corrugations 82 serve to strengthen the bottom of the trough 84. In this way, using corrugations 82, a light-weight material, e.g., plastic can be used to manufacture a corrugated improved masonry reinforcement device. Supports 85 are similar in construction to those of reinforcement device 60.

Referring to FIG. 23, in a special embodiment 90, the bottom of the trough 92 is reinforced for strength with ribs 94 on both longitudinal sides of the trough. The ribs 94 are made of a strong and flexible material to give strength to the bottom of the trough as well as to take up accumulated tolerances in the masonry block. Supports 95 are similar to those of reinforcement devices 60 and 80.

A particularly elegant embodiment of this invention encompasses a hollow masonry block 100. With hollow cells 102 provided with a shelf or ridge 103 around the inside surface 105 of the hollow cell 102. The shelf or ridge 103 is placed at a point below the top 107 of the block and runs parallel to the top 107 of the block 100. The ridge 103 is designed to receive a member such as a reinforced sheet of corrugated plastic 108 so that when the sheet 108 is placed over the ridge 103, the sheet can serve as the trough-bottom of the reinforcement device. In use, for example, a sheet 108 is placed onto ridge 103 forming the bottom of the trough. Then a block in a second course is placed over the first block and cement is dropped in the hollow cell of the top block. The cement will then bind the block in a top course to block in a bottom second course. Shown in FIG. 24, the sheet is a corrugated sheet, however, a sheet with stiffening flanges could be employed. It is obvious that instead of the ridge going all the way around the entire inside of the hollow cell, two ridges could be provided on opposite sides of the hollow cell surface. In still another embodiment for supporting a stiffened sheet for the trough, holes can be provided parallel to the top of the block for receiving pins. Pins then are placed in the holes and the stiffened sheet on the pins is retained by the pins to form a trough. The sheet could also be supported by cantilever brackets instead of the pins or ridges. The distance that the ridge 103 is to be placed below the top of the block will depend on how strong the keying bond is to be. The greater the distance the stronger will be the bond.

Many advantages accrue through the use of this invention.

1. The masonry reinforcement device of this invention will key hollow block together to thereby inexpensively produce added strength to the courses of hollow block used in construction.

2. The masonry reinforcement device, unlike wire mesh reinforcement, will be supplied in individual units to provide reinforcement for a predetermined hollow block masonry unit. Therefore, no cutting to size will be required as with wire mesh; and, further, because the reinforcement is supplied in units, inventory control will be facilitated.

3. The masonry reinforcement device will allow for economical use of cement to bind the blocks. This is so because cement will not simply be thrown into the hollow of the block to entirely fill the hollows to bind the block; but the reinforcement device will catch a relatively small measured amount of cement, to bind one hollow block to the other.

4. Unlike the wire reinforcement of the prior art, the masonry reinforcement device of this invention in use will leave a temporary water mark on the outside of the top and bottom block. In this way, there is an added check to determine whether the mason has properly used the masonry reinforcement device.

5. The masonry reinforcement device is easy to manufacture, easy to package, easy to ship, and easy to maintain inventory control.

6. Since the masonry reinforcement device can be provided with a perforated outdent knock-out and a lateral perforation, the same device can be used for the straight course block, as well as the corner block with outdent. The only modification required when the reinforcement is to be used for a corner block outdent is to remove the perforated knock-out for the outdent, break the lateral perforation to fit the center lateral dividing wall and fit the device into the outdent and hollow of the cell. The removed second half can be used itself over another cell.

7. It is obvious that the flexibility of the bottom flanges and the side supports insures proper seating and the accommodation of manufacturing tolerances of the cells of the block.

Additional advantages are to be attained by the masonry reinforcement device of this invention. Briefly stated, these advantages are as follows:

The device:

can be used with stretcher and corner block;

is useful in reinforcing block in wall openings of various types of construction;

is useful with patch-work where wire is seldom installed;

can be installed along with truss and ladder wire or other anchoring accessories;

will not force mortar in partially filled block out of "green" mortar joints;

can be used to strengthen an entire wall;

will not allow bonding of joint mortar to block to be obstructed;

allows initial dehydration of mortar joints to be delayed because of the additional moisture from cell mortar;

can be fabricated using various light weight materials;

will increase in commercial usefulness because hollow CMU's are becoming more standardized;

can be manufactured and packaged economically.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. In combination with a building wall, wherein at least two hollow core masonry blocks are stacked vertically and are staggered longitudinally, the blocks including an upper block and a lower block having respective communicating cores formed therein, and wherein the blocks have respective flat surfaces between which mortar is placed, a masonry reinforcing device disposed between the upper and lower block and said masonry reinforcing device including at least one trough portion which is received within the core of the lower block, said trough being made of a light-weight material which has been modified by a means for the longitudinal stiffening of the trough to thereby allow a keying amount of cement to be placed in the trough without buckling the trough and causing it to become detached from the block such that additional mortar may be dropped through the core of the upper block to fall into the drough portion of the masonry reinforcing device in the lower block, the additional mortar being sufficient to be disposed conjointly between the respective cores of the upper and lower blocks, thereby vertically keying the upper and lower blocks together for substantially increased vertical strength of the building wall, and such that the additional mortar does not displace the mortar between the respective flat surfaces of the upper and lower blocks.

2. A masonry reinforcing device comprising light-weight stiffened material forming a trough having a top surface, a bottom surface, two opposite edges along the length thereof and two opposite edges along the width thereof, said two opposite edges along the length having fixedly attached along said edges, a flexible flange projecting down and away from the top surface of said trough, said two opposite edges along the width being provided with support members, such that when said masonry reinforcing device is placed into the top of an exposed hollow cell of a masonry block and pressed therein, the flanges will embrace the sides of the hollow cell, taking up accumulated tolerance, and with said support members registering on the top of said exposed hollow cell to properly place the masonry reinforcement device in the hollow cell.

3. A masonry reinforcement device for reinforcing courses of hollow masonry block having a top first end and lateral wall in the center and with said block being used in masonry construction, said masonry reinforcement device being made of light weight stiffened material and comprising a first end, a second end and an elongated surface between said first end and said second end, the first end and second end of said masonry reinforcing device being shaped to fit on the top first end and lateral wall in the center of said hollow masonry block, respectively, the elongated surface between said first end and said second end of the masonry reinforcing device defining a trough to be positioned over a single cell in said block with the bottom of said trough being modified by a means which stiffens the trough and allows cement to be placed therein without buckling the trough, and such that when said masonry reinforcement device is positioned over an exposed cell of hollow masonry block in a bottom course of block, and a top hollow masonry block is set over the bottom block and an adequate amount of mortar dropped into the exposed hollow cell of the top masonry block, the mortar will land in said trough to bind and adhere the interior hollow cell surfaces of both the bottom and top hollow masonry block and thereby form a bond between the blocks.

4. The masonry reinforcement device of claim 3 wherein the means by which the bottom of the trough is stiffened are side flanges.

5. The masonry reinforcement device of claim 3 wherein the means by which the bottom of the trough is stiffened is by means of corrugations or accordion pleats.

6. The masonry reinforcement device of claim 3 wherein the means by which the bottom of the trough is stiffened is by means of side ribs.

7. The masonry reinforcement device of claim 3 wherein the light weight stiffened material is plastic.

8. The masonry reinforcement device of claim 3 being provided with a perforated knock-out to accommodate the outdent of a corner block.

9. In a method for reinforcing masonry hollow block construction the improvement comprising setting the masonry reinforcement device of claim 3 between the courses of block and dropping mortar into the hollow core of a top block to land in the trough of the masonry reinforcement device to thereby vertically key the block set in the adjacent courses of block.

* * * * *